US010276981B2

(12) United States Patent
Matsumoto et al.

(10) Patent No.: US 10,276,981 B2
(45) Date of Patent: Apr. 30, 2019

(54) CONNECTOR MEMBER AND CONNECTOR

(71) Applicant: J.S.T. Mfg. Co., Ltd., Osaka-shi, Osaka (JP)

(72) Inventors: Hiroyuki Matsumoto, Yokohama (JP); Koji Wada, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/651,488

(22) Filed: Jul. 17, 2017

(65) Prior Publication Data

US 2018/0040985 A1 Feb. 8, 2018

(30) Foreign Application Priority Data

Aug. 4, 2016 (JP) ..... 2016-153620

(51) Int. Cl.
*H01R 13/627* (2006.01)
*H01R 13/642* (2006.01)
(Continued)

(52) U.S. Cl.
CPC ..... *H01R 13/642* (2013.01); *H01R 13/10* (2013.01); *H01R 13/415* (2013.01); *H01R 13/50* (2013.01);
(Continued)

(58) Field of Classification Search
CPC .... H01R 13/642; H01R 13/10; H01R 13/415; H01R 13/50; H01R 13/6278; H01R 24/66; H01R 24/76; H01R 2107/00
(Continued)

(56) References Cited

U.S. PATENT DOCUMENTS 3,207,536 A * 9/1965 Lawrence ..... F16L 37/12 24/630
3,368,182 A * 2/1968 Culver ..... H01R 13/6278 285/316
(Continued)

FOREIGN PATENT DOCUMENTS

JP H09-141976 A 6/1997

OTHER PUBLICATIONS

U.S. Appl. No. 15/651,451 by Hiroyuki Matsumoto, et al., filed Jul. 17, 2017 (33 Pages, with 20 Pages drawings).
(Continued)

*Primary Examiner* — Abdullah A Riyami
*Assistant Examiner* — Vladimir Imas
(74) *Attorney, Agent, or Firm* — Kratz, Quintos & Hanson, LLP

(57) ABSTRACT

Provided are a connector member and a connector that suppress breakage due to butting, pressing in a fitting direction. In the connector, a first connector member having a first housing is fitted with a second connector member having a second housing and a supporting member having a cylindrical shape that supports the second housing. The second housing has a pair of shaft pins formed at positions opposed to each other on the supporting member side. The supporting member has a support claw including a pair of claw pieces that are elastically deformable and hold each of the shaft pins. After the first connector member and the second connector member are fitted together, when a pressure is applied thereto in a fitting direction, the shaft pins are moved to cause the claw pieces of the support claw to elastically deform, causing the shaft pins to detach from the support claw.

10 Claims, 20 Drawing Sheets

(51) Int. Cl.

| | |
|---|---|
| ***H01R 24/66*** | (2011.01) |
| ***H01R 24/76*** | (2011.01) |
| ***H01R 13/50*** | (2006.01) |
| ***H01R 13/415*** | (2006.01) |
| ***H01R 13/10*** | (2006.01) |
| ***H01R 13/631*** | (2006.01) |
| *H01R 107/00* | (2006.01) |

(52) U.S. Cl.
CPC ..... *H01R 13/6278* (2013.01); *H01R 13/6315* (2013.01); *H01R 24/66* (2013.01); *H01R 24/76* (2013.01); *H01R 2107/00* (2013.01)

(58) Field of Classification Search
USPC ..... 439/357
See application file for complete search history.

(56) References Cited

U.S. PATENT DOCUMENTS 3,733,577 A * 5/1973 Hammond ..... H01R 13/6278 24/630
4,174,879 A * 11/1979 Suverison ..... H01R 13/6278 439/344
5,357,658 A * 10/1994 Tanaka ..... A44B 11/2523 24/633
5,376,016 A * 12/1994 Inaba ..... H01R 13/6215 439/357
6,315,585 B1 * 11/2001 Oka ..... H01R 13/62938 439/157
6,368,127 B1 * 4/2002 Araki ..... B60R 16/027 439/15
6,805,575 B2 * 10/2004 Lappohn ..... H01R 9/18 439/381
7,249,958 B2 * 7/2007 Ishikawa ..... H01R 13/631 439/140
7,374,460 B1 * 5/2008 Hariharesan ..... H01R 13/187 439/679
7,476,133 B2 * 1/2009 Tanaka ..... H01R 13/4364 439/752
7,955,110 B1 * 6/2011 Kataoka ..... H01R 13/6215 439/284
9,225,116 B2 * 12/2015 McKibben ..... H01R 13/20
9,425,534 B2 * 8/2016 Schmidt ..... H01R 13/6272
9,553,407 B2 * 1/2017 McDowall ..... H01R 13/6275
9,705,252 B2 * 7/2017 Goto ..... H01R 13/6581
2014/0170888 A1 * 6/2014 Chien ..... H01R 13/635 439/352

OTHER PUBLICATIONS

U.S. Appl. No. 15/651,474 by Hiroyuki Matsumoto, et al., filed Jul. 17, 2017 (35 Pages, with 20 Pages drawings).

* cited by examiner

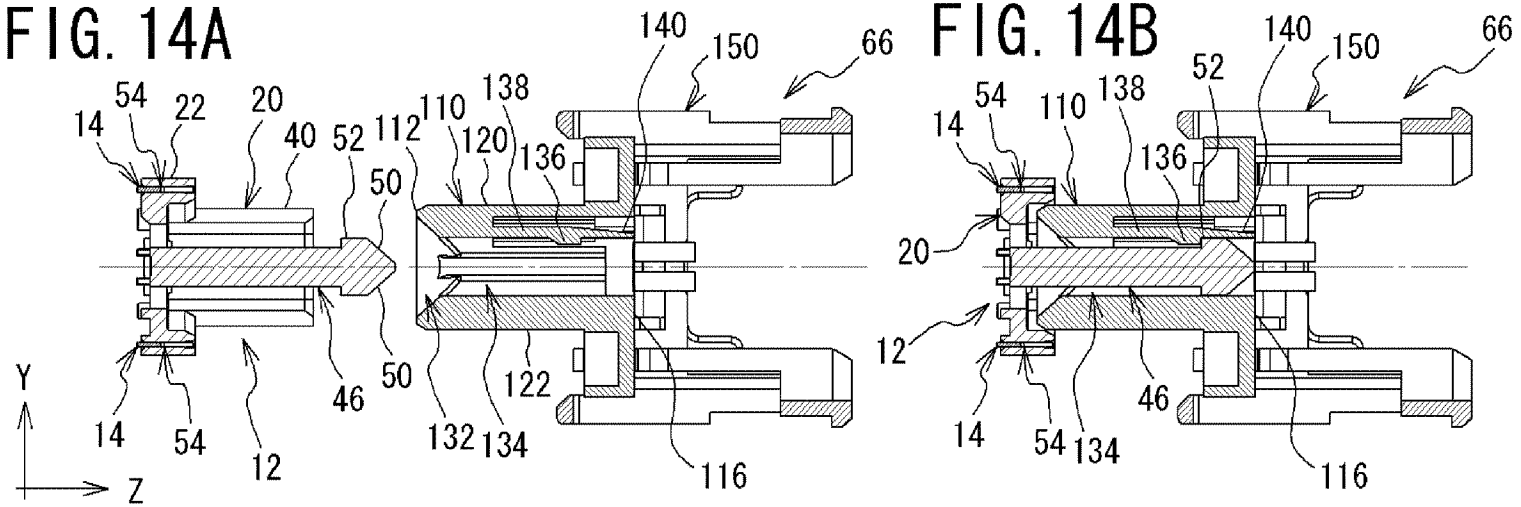
FIG. 14A
FIG. 14B
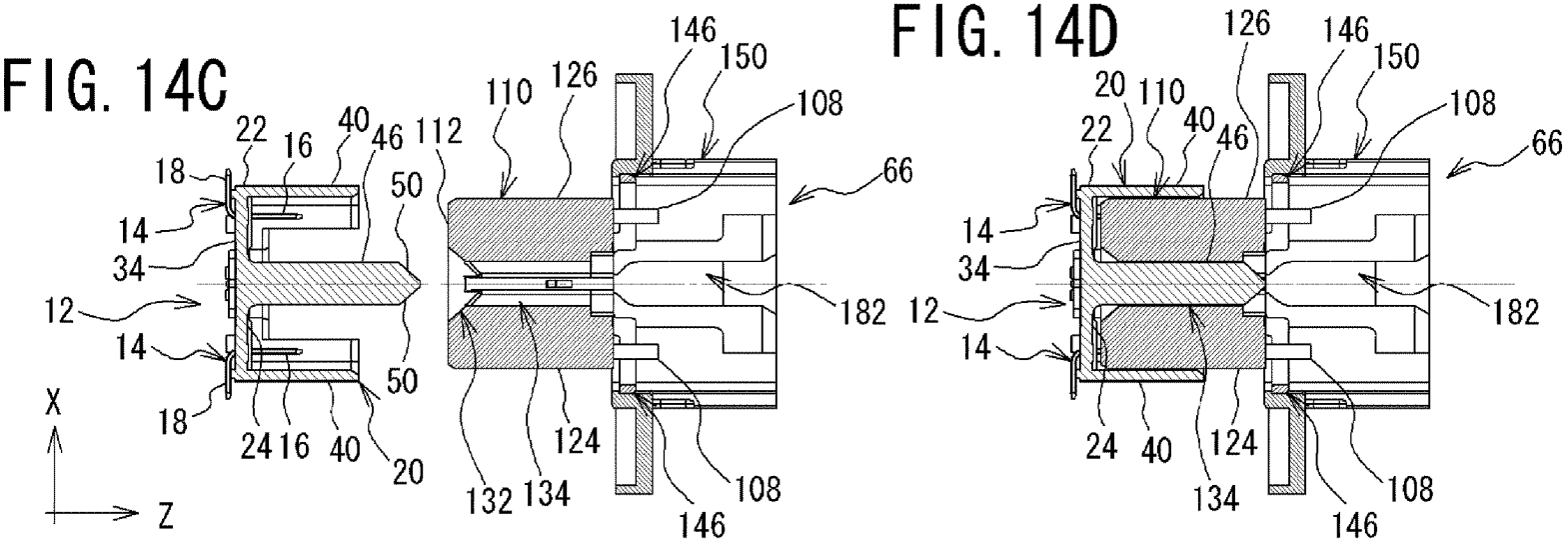
FIG. 14C
FIG. 14D 12
14
20
40
46
50
D1
110
124
126
132
134
146
150
168
170
182
184
190
196
128
66
X
Z

XVIC
θ1
Z
X 12
14
20
42
110
182
190
128
196
146
184
170
32
150
168
66
Z
X

CONNECTOR MEMBER AND CONNECTOR

BACKGROUND

Technical Field

The present invention relates to a connector member and a connector that suppress breakage due to butting, pressing, or the like in a fitting direction.

Related Art

For example, JP H09-147976 A discloses an invention of a connector that can be coupled from a dislocated position to an opponent connector. The connector disclosed in JP H09-147976 A consists of a housing that is coupled with the opponent connector, and a holder that holds the housing movably in vertical and horizontal directions. In the connector, the housing is provided with a taper part that is tapered toward depth direction and guides the opponent connector, and the holder is provided with an energizing means that energizes the housing to a predetermined position, and an engagement means that engages with a mounting body.

SUMMARY

In the connector disclosed in JP H09-147976 A, when an additional force is applied in a coupling direction after coupling, there is a risk of breakage of a connector itself or a portion attached by soldering or the like in mounting of the connector on a substrate.

An object of the present invention is to provide a connector member and a connector that are capable of suppressing breakage or the like due to butting or pressing in a fitting direction.

To solve the aforementioned problems, a connector member according to a first aspect of the present invention includes a housing that contains at least one contact, and a supporting member that has a cylindrical shape and supports the housing inside, and the connector member is fitted to a counterpart connector member. The connector member is configured such that:

the housing has a pair of shaft pins formed at positions opposed to each other on the supporting member side;

the supporting member has a support claw that is elastically deformable and configured by a pair of claw pieces that hold each of the shaft pins; and when the housing is pressed in a fitting direction, the shaft pins are moved to cause the claw pieces of the support claw to elastically deform, causing the shaft pins to detach from the support claw.

A connector member according to a second aspect of the present invention is configured such that: in the connector member of the first aspect, the housing has a pair of elastic supporting members that are formed at positions opposed to each other on the supporting member side and orthogonal to the shaft pins, and are elastically deformable;

the supporting member has a supporting part that supports each of the elastic supporting members;

each of the elastic supporting members is formed of an oval spring body having a curved surface portion that has a curved surface shape and is supported by the supporting part of the supporting member; and the supporting part of the supporting member is formed with a curved-surface concave portion capable of being fitted with the curved surface portion of each of the elastic supporting members.

In a connector according to one aspect of the present invention, a first connector member having a first housing that contains at least one first contact is fitted with a second connector member having a second housing that contains at least one second contact to be contacted with the first contact, and a supporting member that has a cylindrical shape and supports the second housing inside. The connector is configured such that:

the second housing has a pair of shaft pins formed at positions opposed to each other on the supporting member side;

the supporting member has a support claw that is configured by a pair of claw pieces that hold each of the shaft pins, and the support claw is elastically deformable; and after the first connector member and the second connector member are fitted together, when a pressure is applied thereto in a fitting direction, the shaft pins are moved to cause the claw pieces of the support claw to elastically deform, causing the shaft pins to detach from the support claw.

A connector according to one aspect of the present invention is configured such that, in the connector of the above aspect, at portions opposed to each other at end sides of the claw pieces of the support claw, there is formed a recessed portion into which each of the shaft pins is fitted, and a holding part configured by holding projection parts protruding on both ends of the recessed portion.

A connector according to one aspect of the present invention is configured such that, in the connector of the above aspect, the holding claw is configured to be elastically deformed by a larger pressing force than that of when the first connector member is fitted with the second connector member.

A connector according to one aspect of the present invention is configured such that: in the connector of the above aspect, the second housing has a pair of elastic supporting members that are formed at positions opposed to each other on the supporting member side and orthogonal to the shaft pins, and are elastically deformable;

the supporting member has a supporting part that supports each of the elastic supporting members;

each of the elastic supporting members is formed of an oval spring body having a curved surface portion that has a curved surface shape and is supported by the supporting part of the supporting member; and the supporting part of the supporting member is formed with a curved-surface concave portion capable of being fitted with the curved surface portion of each of the elastic supporting members.

A connector according to one aspect of the present invention is configured such that, in the connector of the sixth aspect, in the curved-surface concave portion of the supporting part, a side to be fitted with the first connector is closed, and there is provided an abutting part against which the curved surface portion of each of the elastic supporting members of the second housing abuts.

A connector according to one aspect of the present invention is configured such that: in the connector of the above aspect, the first housing is formed with a guide pin that is extended to a side to be fitted to the second housing; and inside the second housing, there is formed a guide-pin guiding part that is inserted with the guide pin, and the guide-pin guiding part is, on a side to be inserted with the guide pin, formed with a guide hole that guides the guide pin to the guide-pin guiding part.

A connector according to one aspect of the present invention is configured such that: in the connector of the above aspect, in the guide pin, a cross section orthogonal to an extending direction is formed into a polygonal shape, and a tapered portion is formed in which a tip side to be inserted into the guide hole is chamfered;

the guide-pin guiding part is formed into a shape corresponding to a shape of the guide pin; and the guide hole is formed into a chamfered conical shape.

A connector according to one aspect of the present invention is configured such that: in the connector of the above aspect, the guide-pin guiding part is formed with a lock piece capable of repeatedly moving, and a lock projection that is formed to protrude on the lock piece;

the guide pin is formed with a lock part to be engaged with the lock projection;

when the first connector and the second connector are fitted, the lock projection of the guide-pin guiding part is engaged to the lock part of the guide pin to fix the first connector and the second connector; and moving a lock piece causes the lock projection to move and disengage from the lock part.

According to the connector member of the first aspect of the present invention, even when an external force is applied due to butting, pressing, or the like, breakage of the connector member can be suppressed by detachment of the housing from the supporting member.

According to the connector member of the second aspect of the present invention, in assembling the housing and the supporting member, fitting the curved surface portion of the elastic supporting member of the housing into the curved-surface concave portion of the supporting part of the supporting member allows the housing to be moved and arranged to any position of the supporting member, for example, a center position. Moreover, elastic deformation of the elastic supporting member enables movement of the housing inside the supporting member.

According to the connector of one aspect of the present invention, when a pressure is applied in the fitting direction after the fitting of the first connector and the second connector, the second housing is detached from the supporting member, so that it is possible to suppress breakage or the like of connector members or a portion attached by soldering in mounting of the connector member on a substrate or the like.

According to the connector of one aspect of the present invention, each of the shaft pins is easily held by the support claw.

According to the connector of one aspect of the present invention, the first connector and the second connector can be fitted without detaching the second housing from the supporting member.

According to the connector of one aspect of the present invention, fitting the curved surface portion of the elastic supporting member of the housing into the curved-surface concave portion of the supporting part of the supporting member allows the housing to be moved and arranged to any position of the supporting member, for example, a center position.

According to the connector of one aspect of the present invention, in a state where the second housing is supported by the supporting member, abutting the abutting part of the supporting part to the curved surface portion of each of the elastic supporting members enables suppression of movement of the second housing.

According to the connector of one aspect of the present invention, the first connector and the second connector can be smoothly fitted.

According to the connector of one aspect of the present invention, even when the first connector and the second connector are misaligned in a rotational direction, inserting the guide pin into the guide-pin guiding part causes the guide-pin guiding part to be fitted with the guide pin formed into a polygonal shape, such as a cross shape, allowing the second housing to be rotationally moved and adjusted to be fittable.

According to the connector of one aspect of the present invention, the first connector member and the second connector member can be easily fixed and released from the fixing.

BRIEF DESCRIPTION OF DRAWINGS

FIG. 14A is a cross-sectional view of XIVA-XIVA line in FIG. 1A, FIG. 14B is a cross-sectional view illustrating a process of fitting following FIG. 14A, FIG. 14C is a cross-sectional view of XIVC-XIVC line in FIG. 1A, and FIG. 14D is a cross-sectional view illustrating a process of fitting following FIG. 14C.

DETAILED DESCRIPTION

An embodiment of the present invention is described below with reference to drawings. However, the following embodiment is illustrative of a connector member and a connector in order to embody a technical idea of the present invention, which is not meant to be limiting the present invention on these, and can be equally applied to those of other embodiments included in the appended claims.

Embodiment

Figure 1A:
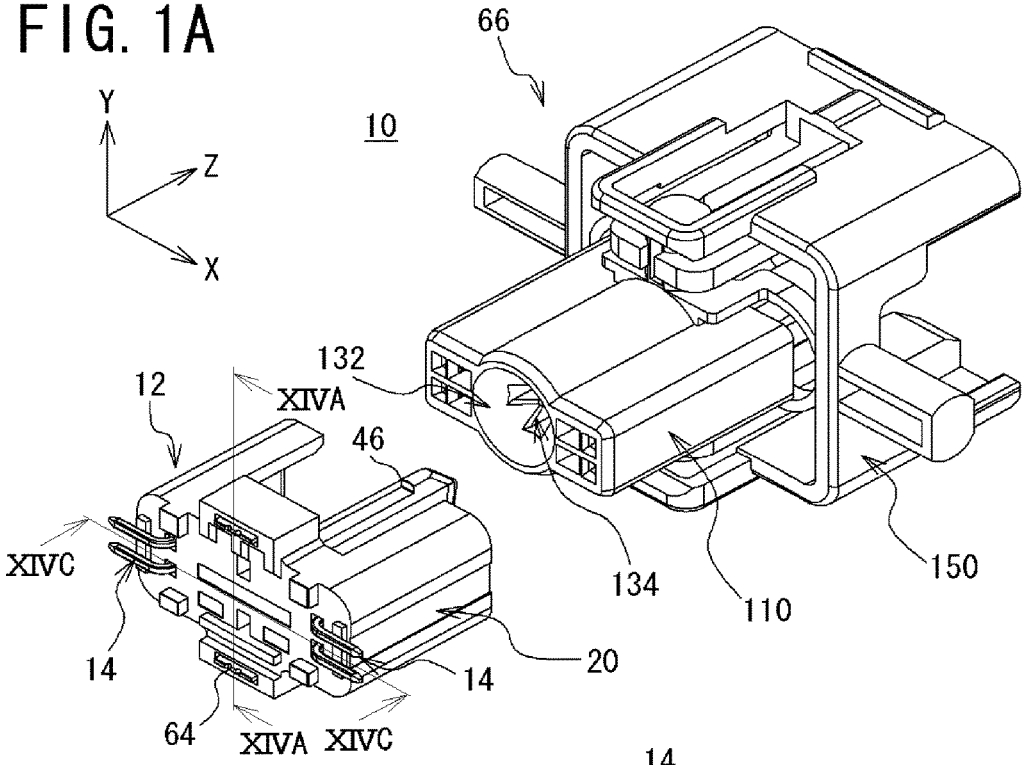
FIG. 1A is a perspective view illustrating a state before connecting a first connector member and a second connector member of a connector according to an embodiment as viewed from one side.

A connector 10 according to an embodiment is described with reference to FIGS. 1A to 20C. The connector 10 of the embodiment is, as illustrated in FIGS. 1A to 2, has a first connector member 12 that is mounted on a substrate or the like, and a second connector member 66 as a connector member that is attached to a device or the like, and is fitted to the first connector member 12. The connector 10 is configured such that the first connector member 12 and the second connector member 66 are attachable and detachable. Moreover, the connector 10 of the embodiment is configured such that, even when axes that are to be a center in fitting of the first connector member 12 and the second connector member 66 (hereinafter referred to as fitting axes) are misaligned or inclined to each other, fitting is performed with the misalignment or inclination of the fitting axes adjusted, and it is possible to suppress occurrence of a failure such as breakage of the first connector member and the second connector member when a large force is applied in a fitting direction.

First, the first connector member 12 is described with reference to FIGS. 3A to 4C. The first connector member 12 has at least one first contact 14, which is four first contacts 14 in the embodiment, a first housing 20 that is mounted with each of the first contacts 14, and a reinforcing member 64 that fixes the first housing 20 to a substrate or the like.

Figure 3A:
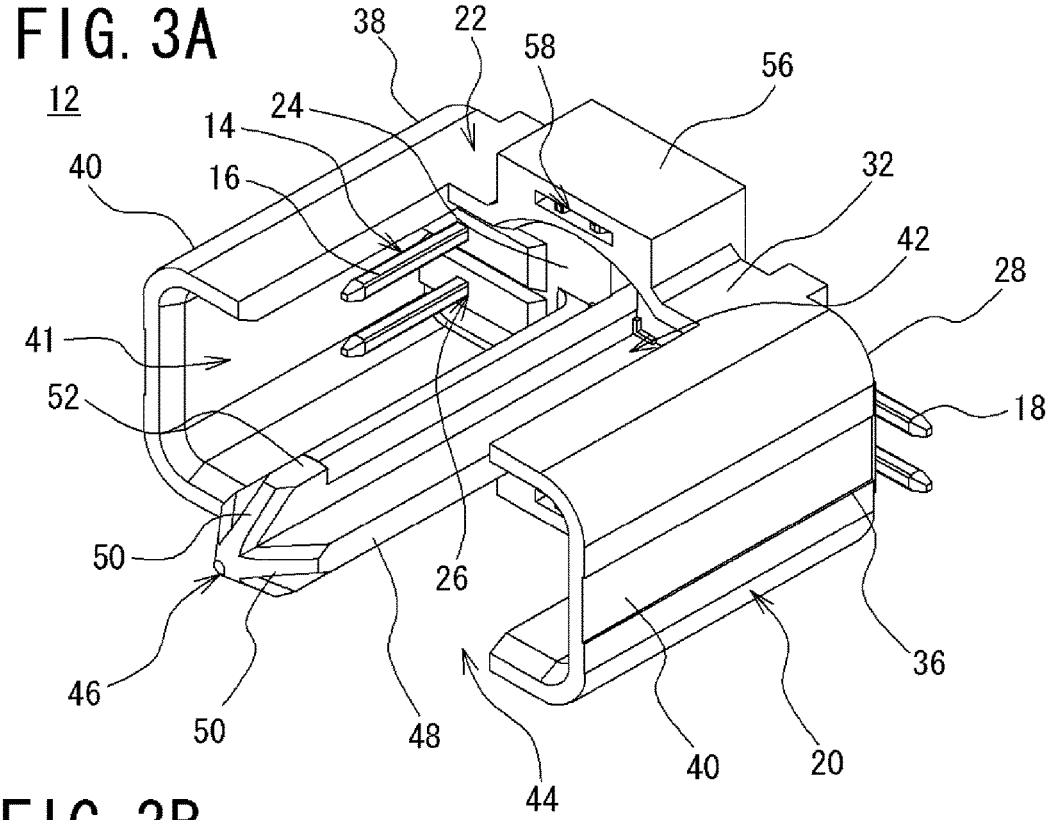
FIG. 3A is a perspective view of the first connector member according to the embodiment as viewed from one side.
Figure 3B:
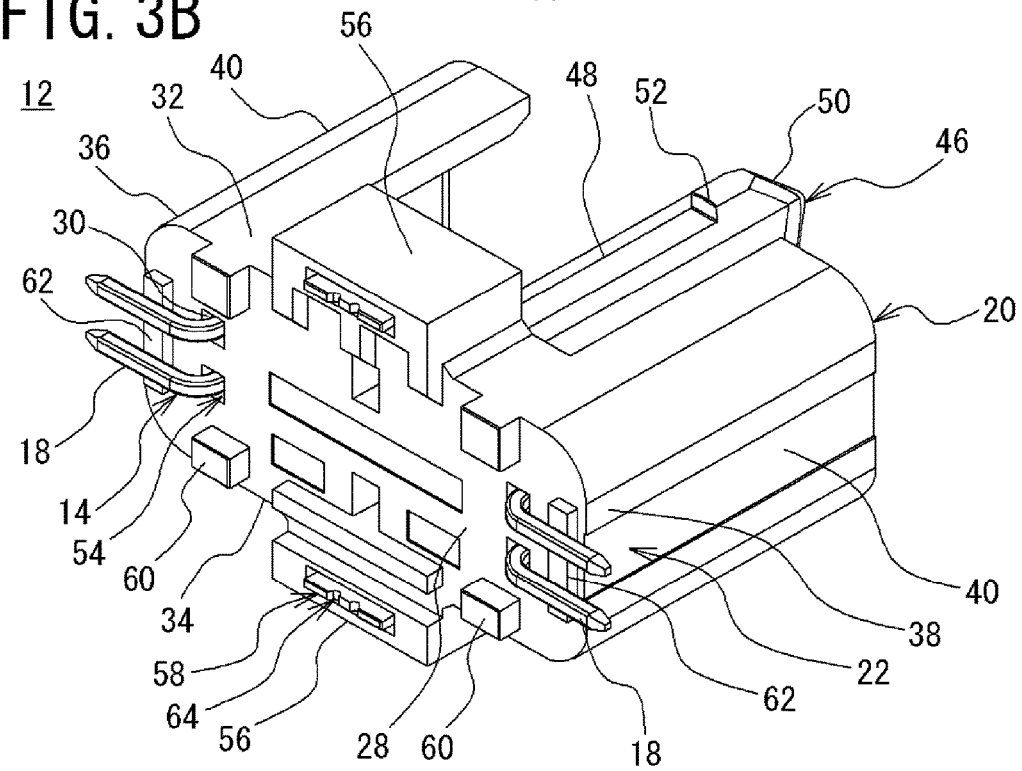
FIG. 3B is a perspective view as viewed from another side.
Figure 4A:
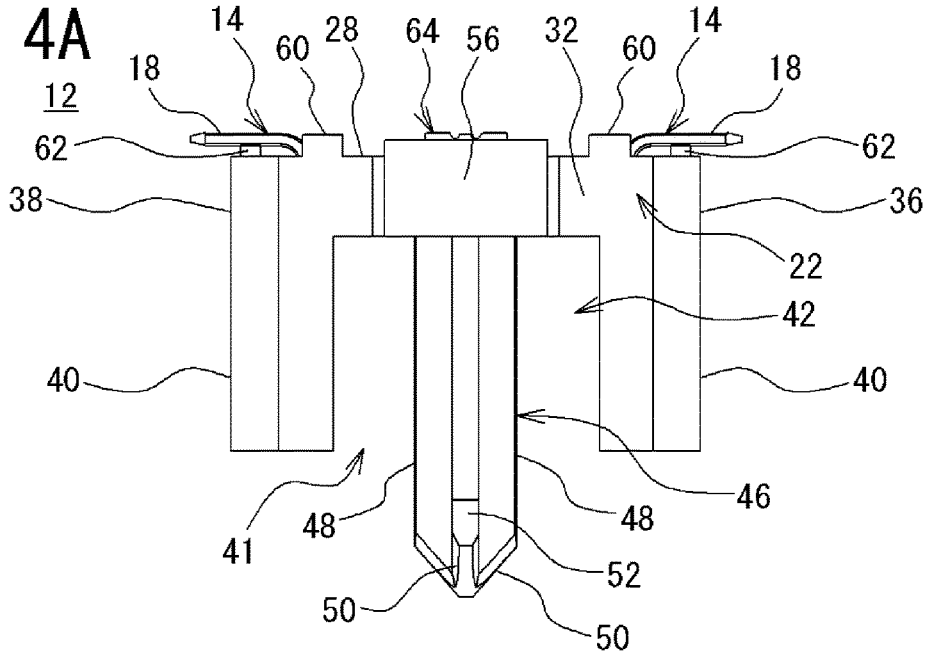
FIG. 4A is a plan view of the first connector member according to the embodiment.
Figure 4B:
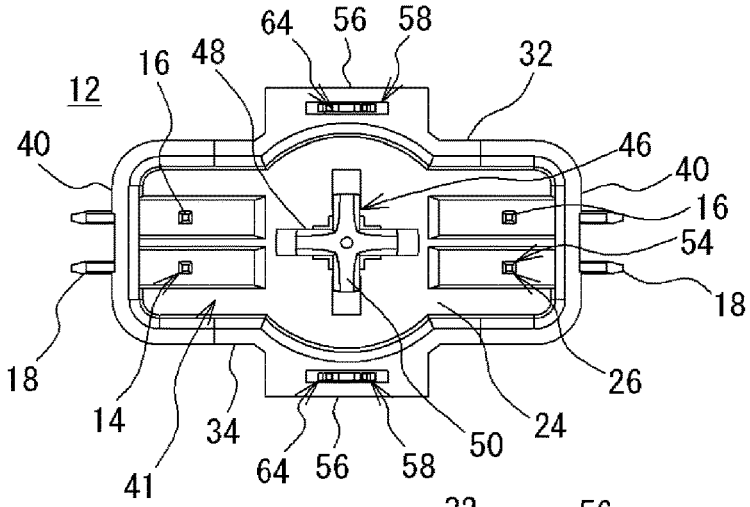
FIG. 4B is a front view.
Figure 4C:
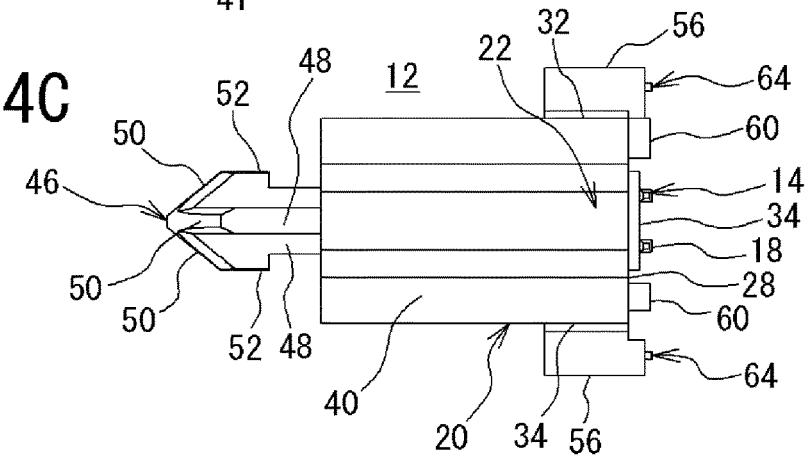
FIG. 4C is a side view as viewed from one side.
Figure 5A:
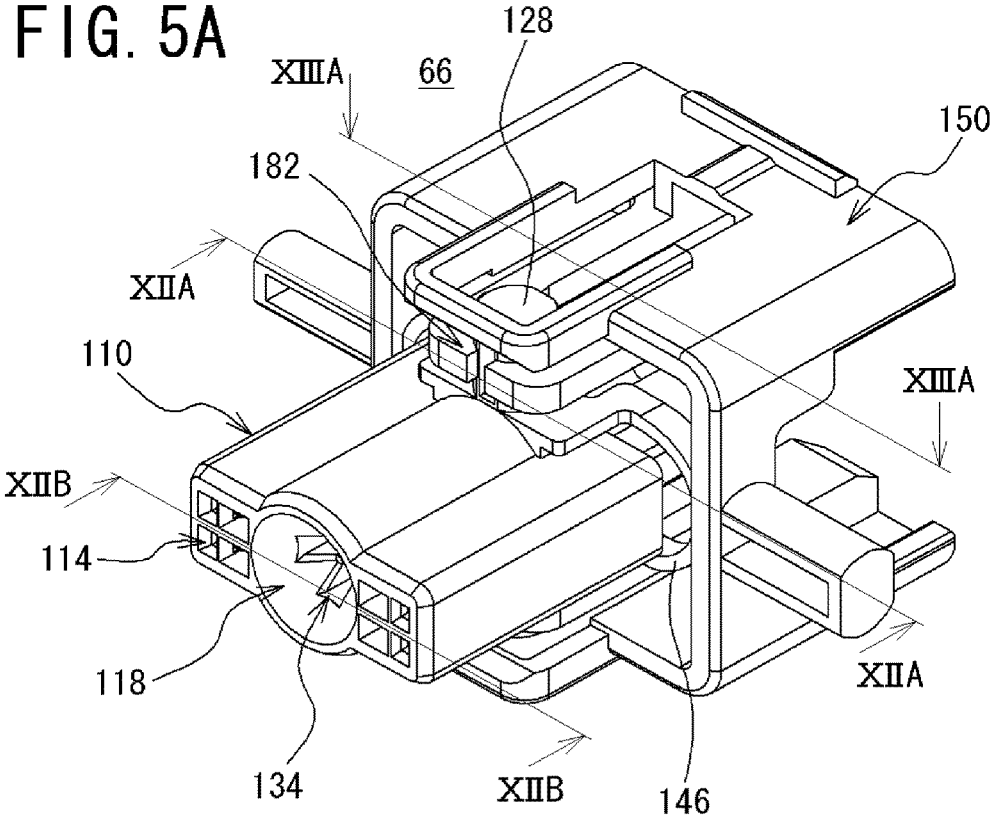
FIG. 5A is a perspective view of the second connector member according to the embodiment as viewed from one side.
Figure 5B:
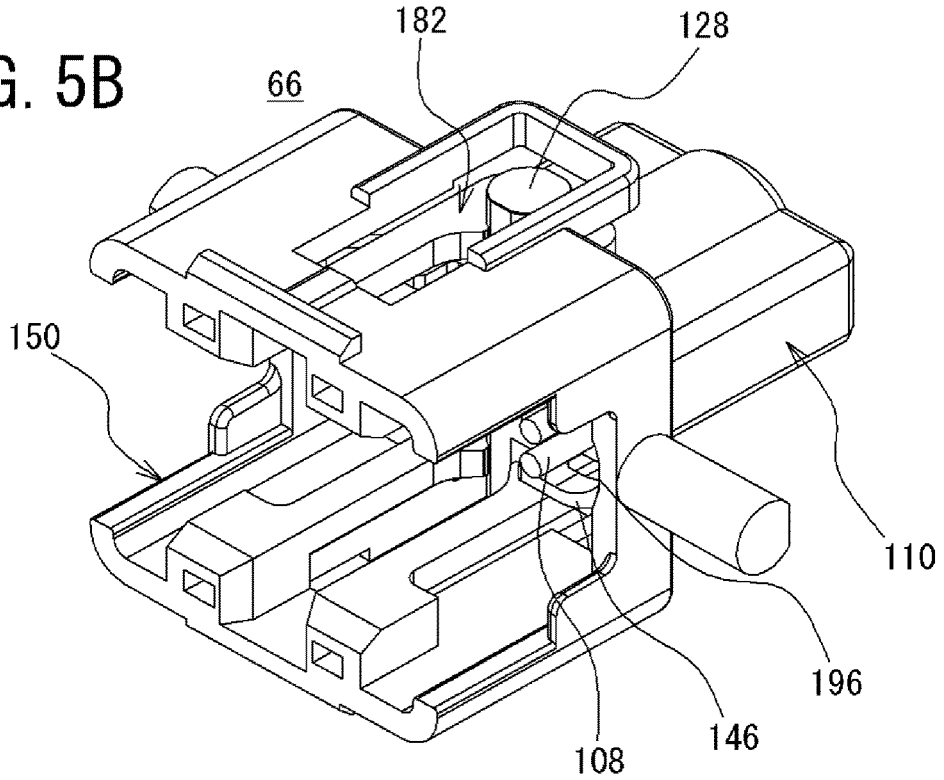
FIG. 5B is a perspective view as viewed from another side.
Figure 6A:
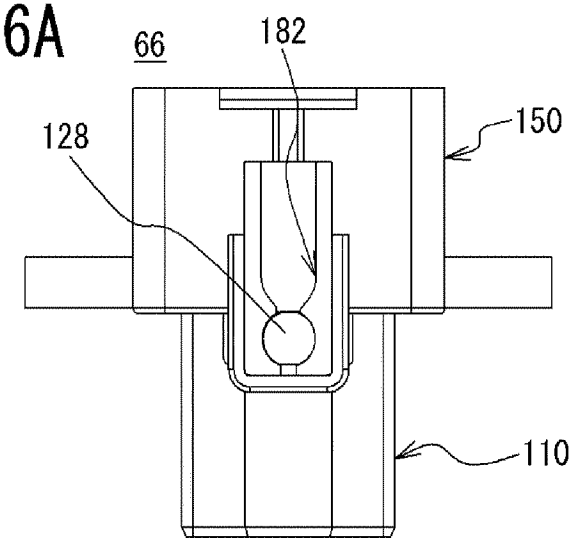
FIG. 6A is a plan view of the second connector member according to the embodiment.
Figure 6C:
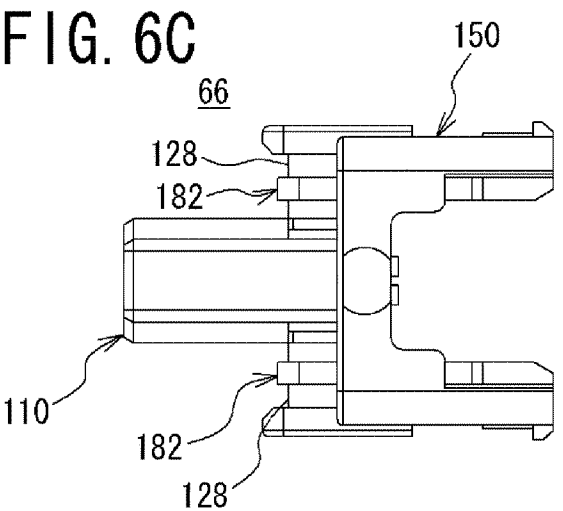
FIG. 6C is a side view as viewed from one side.
Figure 6B:
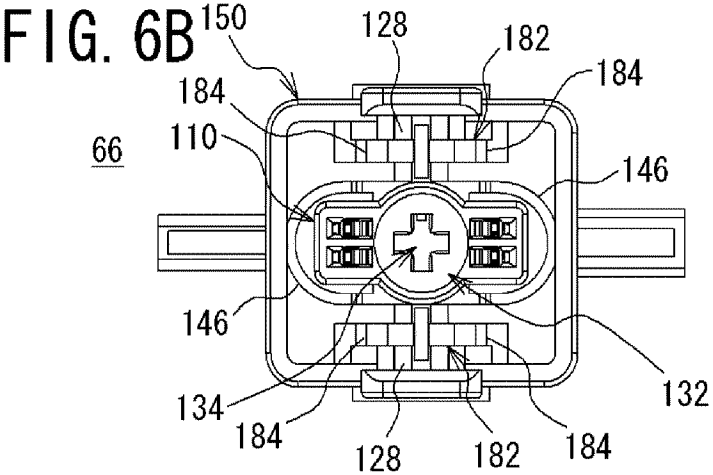
FIG. 6B is a front view.
Figure 6D:
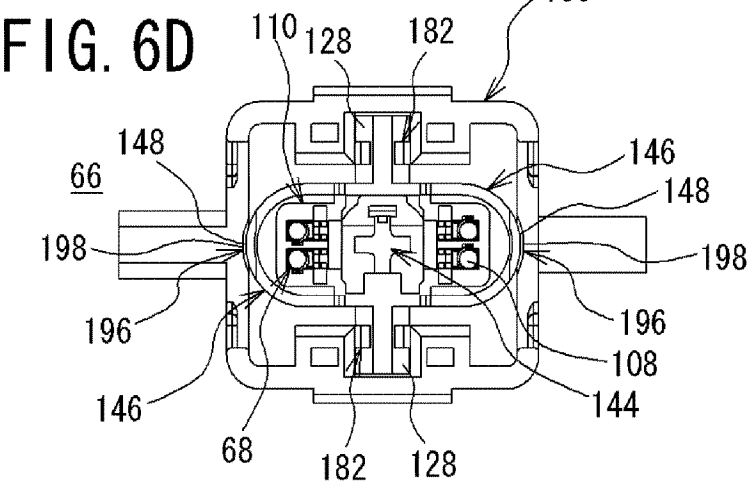
FIG. 6D is a rear view.

As illustrated in FIGS. 3A and 3B, the first contacts 14 each have a common configuration, and are formed in a substantially L-shape in which a metal rod is bent at a predetermined position. The first contacts 14 each have, on one side, a first contact part 16 that is contacted with a second contact 68 provided to the second connector member 66, and on another side, a connection part 18 that is connected to a substrate or the like.

As illustrated in FIGS. 3A to 4C, the first housing 20 is configured by a first front surface 24 formed with a front-surface-side open hole 26 that is protruded with the first contact part 16 side of the first contact 14; a first rear surface 28 formed with a rear-surface-side open hole 30 that is protruded with the connection part 18 sides of the first contacts 14; a first housing body 22 having a first upper surface 32, a first bottom surface 34, a one first-side-surface 36, and an another first-side-surface 38; a guide-enclosing part 40 extending to a side to be fitted to the second connector member 66, from a periphery on the first front surface 24 side of the first housing body 22, namely, from an end side of the first upper surface 32 side, the first bottom surface 34 side, the one first-side-surface 36 side, and the another first-side-surface 38 side; and a guide pin 46, in a rod shape for example, that protrudes from substantially center of the first front surface 24 to the side to be fitted to the second connector member 66. The first housing 20 is integrally formed of a resin material.

Inside the first housing body 22 of the first housing 20 is formed with first contact containers 54 that each contain each of the first contacts 14 (see FIGS. 14A to 14D). These first contact containers 54 are formed such that the front-surface-side open hole 26 of the first front surface 24 and the rear-surface-side open hole 30 can be connected.

The first front surface 24 of the first housing body 22 is formed with a plurality of front-surface-side open holes 26 that are protruded with the first contact part 16 sides of the first contacts 14. In the embodiment, two front-surface-side open holes 26 are formed on each of the one first-side-surface 36 side and another first-side-surface 38, thus four of them are formed in total. A portion formed with the front-surface-side open holes 26, of the first front surface 24, is formed to have a thickness so as to be raised as compared with other portions.

On a substantially center portion of the first front surface 24, there is extended the guide pin 46 that protrudes in a direction to be fitted to the second connector member 66. As illustrated in FIGS. 3A and 3B, this guide pin 46 is formed into a cross shape with each corner of a rod-shaped rectangular parallelepiped cut out, and has a shape where four guide pieces 48 that each are erected over a longitudinal direction. A tip side of each of the cross shaped guide pieces 48 of the guide pin 46 is chamfered, and formed with a tapered portion 50. In the embodiment, each of the guide pieces 48 on the cross-shaped first upper surface 32 side and on the first bottom surface 34 side of the guide pin 46 is formed with a lock part 52 that is formed to protrude by cutting a portion.

On the first front surface 24 side, there is formed the guide-enclosing part 40 that guides a second housing 110 of the second connector member 66. This guide-enclosing part 40 is formed cylindrically extending from a periphery of the first front surface 24, namely, from the first upper surface 32 side, the first bottom surface 34 side, the one first-side-surface 36 side, and the another first-side-surface 38 side, and is provided with a fitting port 41 on the side to be fitted with the second housing 110. The first upper surface 32 side and the first bottom surface 34 side of the guide-enclosing part 40 are respectively formed with an upper-surface open part 42 and a bottom surface open part 44 in which a part of a center portion is opened. The upper-surface open part 42 and the bottom surface open part 44 are configured capable of being entered with a support claw 182 formed to the supporting member 150 of the second connector member 66 described later.

The first rear surface 28 of the first housing body 22 is formed with the rear-surface-side open hole 30 that is coupled to the front-surface-side open hole 26 formed on the first front surface 24, in which two rear-surface-side open holes 30 are formed on each of the one first-side-surface 36 side and the another first-side-surface 38, thus four of them are formed in total.

The first rear surface 28 is formed with a plurality of leg portions 60 that are contacted when attached to a substrate or the like. On a portion where the first contact part 16 of the first contacts 14 is disposed, there is formed a short leg portion 62 that is shorter than the leg portions 60, each on the one first-side-surface 36 side and the another first-side-surface 38 side. These short leg portions 62 are parts to be placed on the first contacts 14 when the first connector member 12 is attached to a substrate or the like.

Each of the first upper surface 32 and the first bottom surface 34 of the first housing body 22 is formed with a protrusion 56 that partially protrudes. Inside the protrusion 56 is formed with a penetration part 58 that penetrates from the first front surface 24 side to the first rear surface 28 side. This penetration part 58 is to be attached with the reinforcing member 64 that is attached to a substrate or the like. The guide pin is not limited to the cross shape, but may also be formed in, for example, a polygonal shape such as a triangle shape or a square shape, and formed with a tapered portion with a tip part chamfered.

In the embodiment, the guide pin 46 of the first housing 20 is formed to be longer than the guide-enclosing part 40, and the guide pin 46 is to be inserted first to the second connector member 66 prior to the guide-enclosing part 40.

Next, the second connector member 66 is described with reference to FIGS. 2, and 5A to 13C. The second connector member 66 is configured by at least one second contact 68, which is four second contacts 68 in the embodiment, that is connected with a wire; the second housing 110 that contains the second contacts 68; and the supporting member 150 that supports the second housing 110 and is attached to a device or the like. The second connector member 66 is configured capable of adjusting misalignment, inclination, or the like in accordance with a state of the misalignment, the inclination, or the like of a fitting axis with respect to the first connector member 12.

Figure 7A:
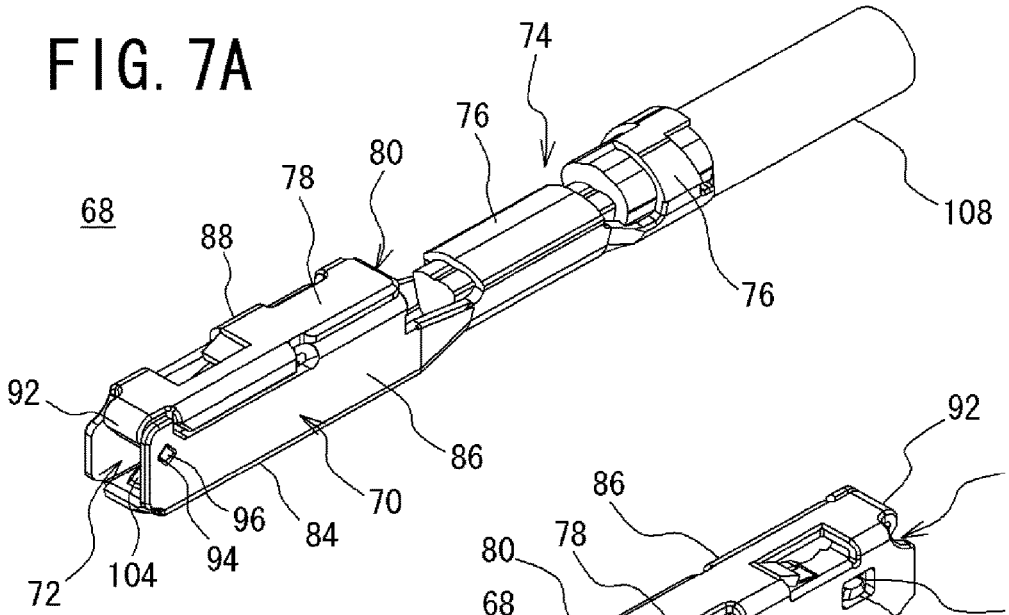
FIG. 7A is a perspective view of a second contact connected with a wire according to the embodiment as viewed from one side.
Figure 7B:
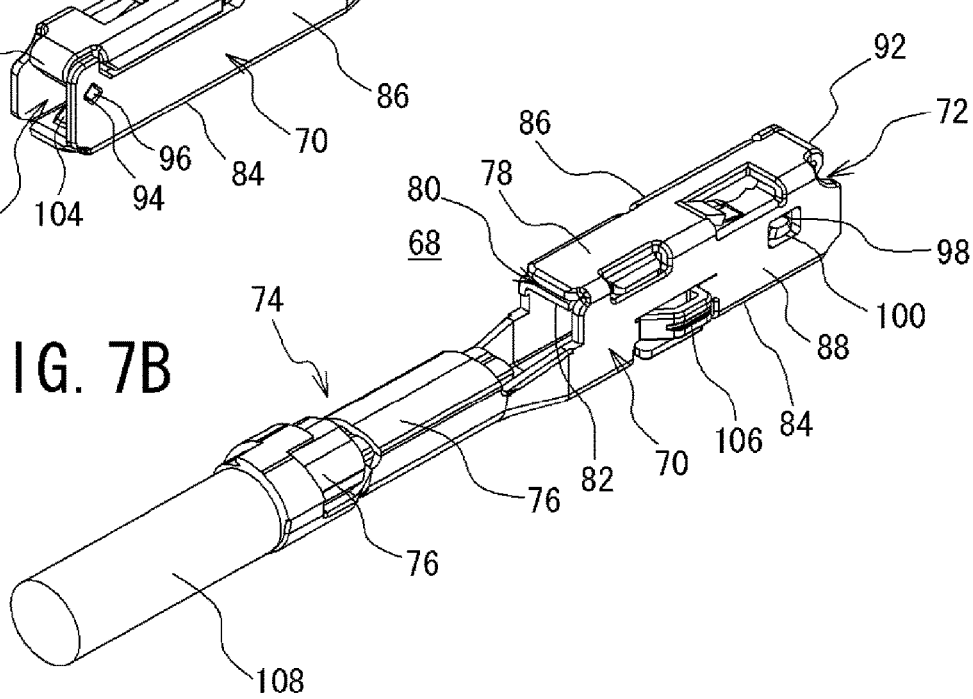
FIG. 7B is a perspective view as viewed from another side.
Figure 7C:
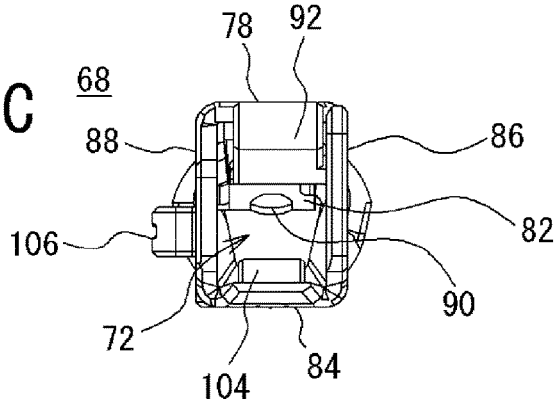
FIG. 7C is a front view.
Figure 8A:
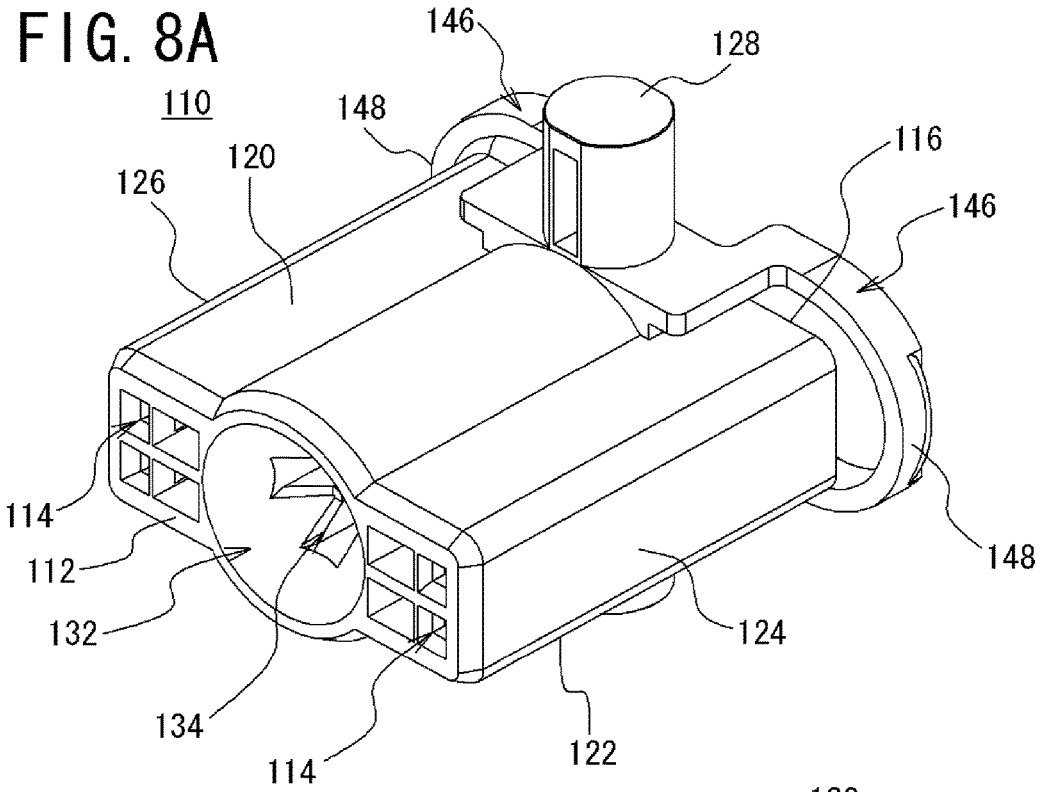
FIG. 8A is a perspective view of a second housing according to the embodiment as viewed from one side.
Figure 8B:
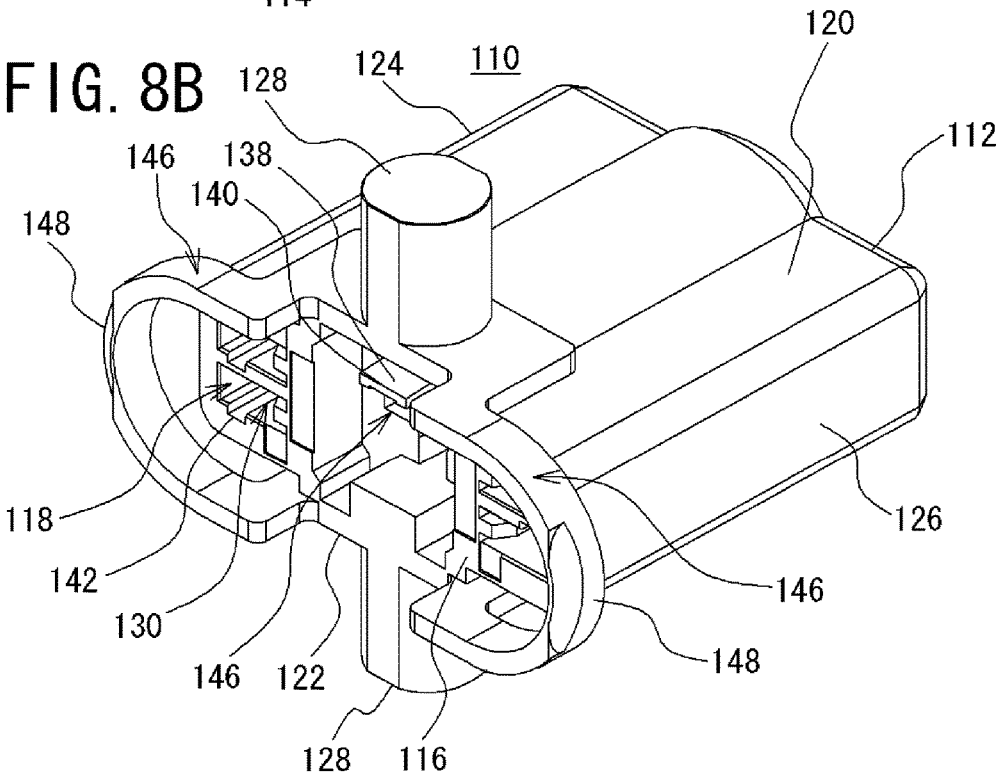
FIG. 8B is a perspective view as viewed from another side.
Figure 9C:
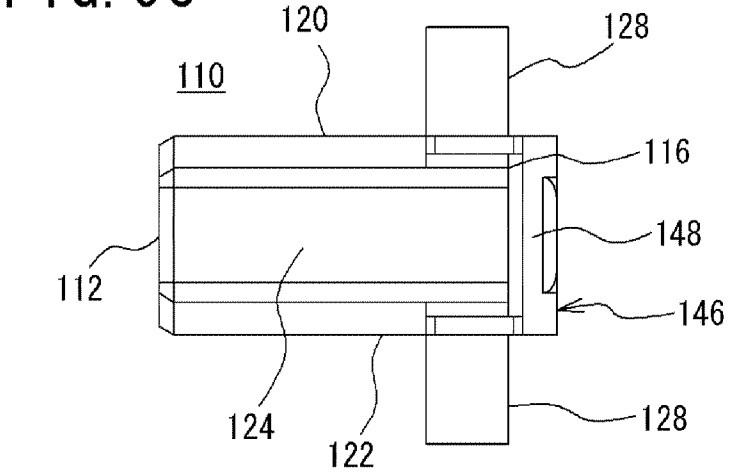
FIG. 9C is a side view as viewed from one side.
Figure 9D:
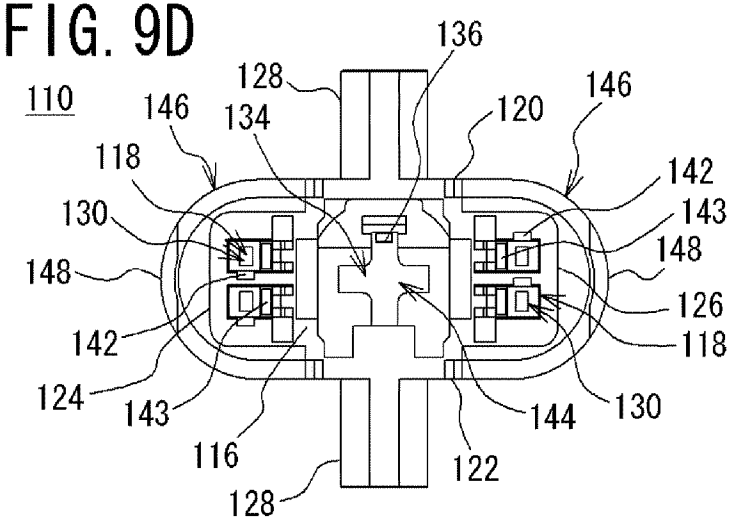
FIG. 9D is a rear view.
Figure 9A:
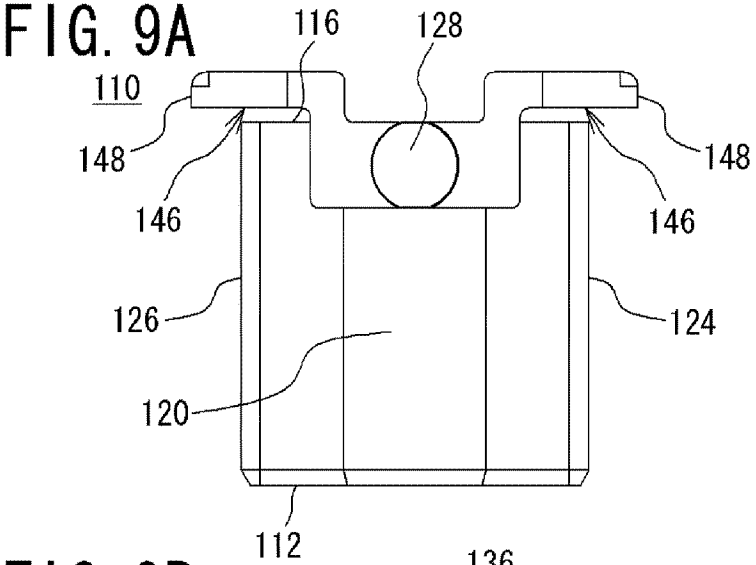
FIG. 9A is a plan view of the second housing according to the embodiment.
Figure 9B:
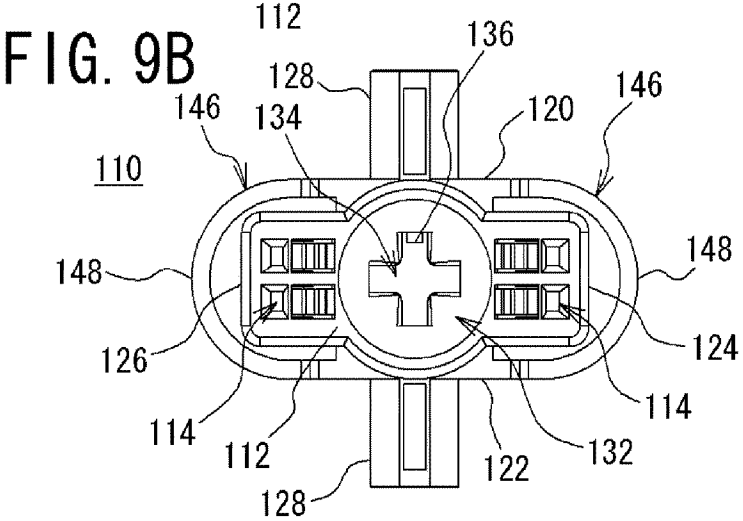
FIG. 9B is a front view.
Figure 10A:
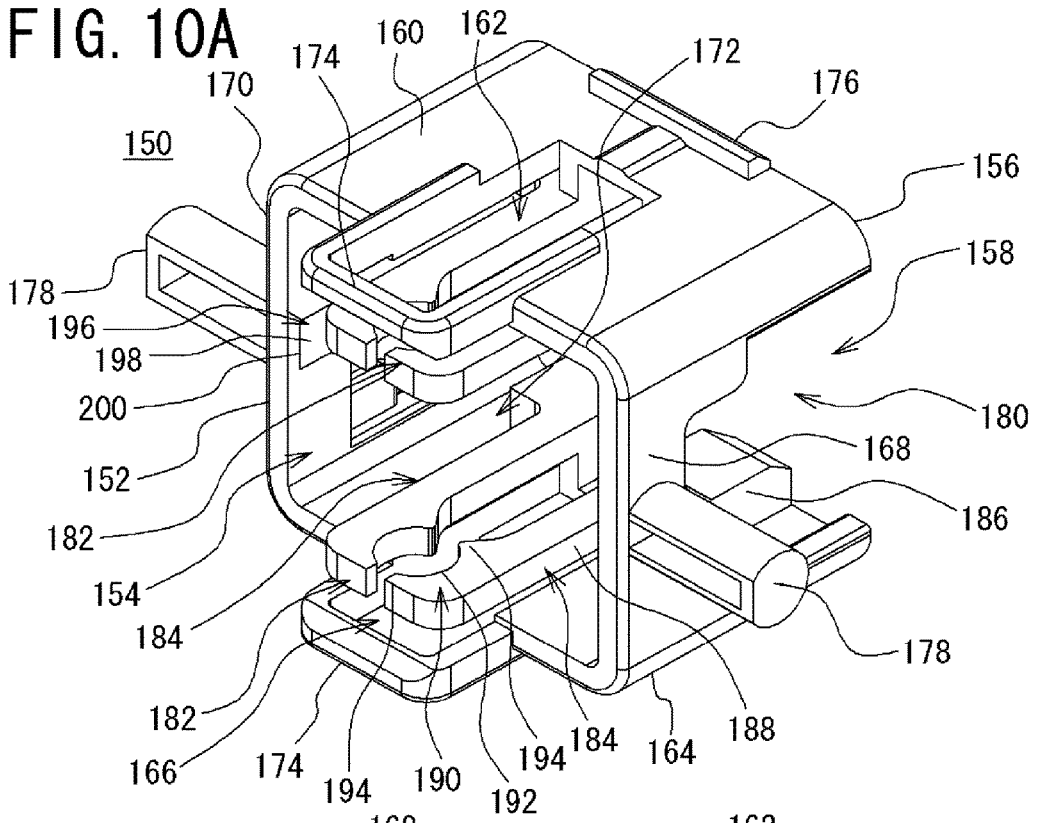
FIG. 10A is a perspective view of a supporting member according to the embodiment as viewed from one side.
Figure 10B:
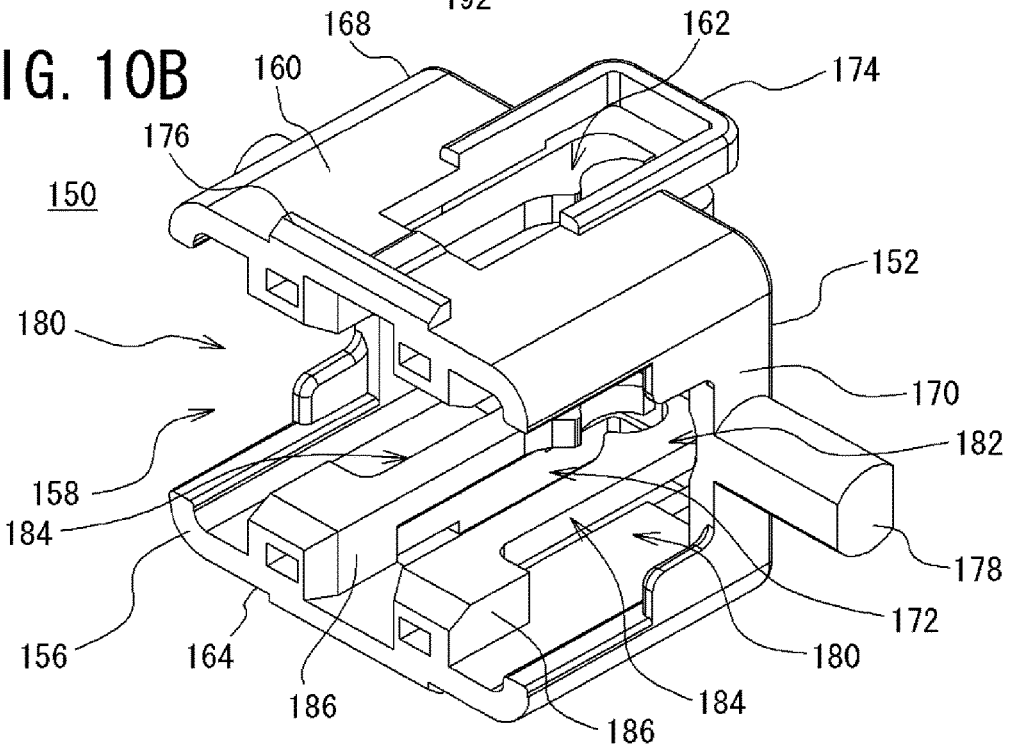
FIG. 10B is a perspective view as viewed from another side.
Figure 11C:
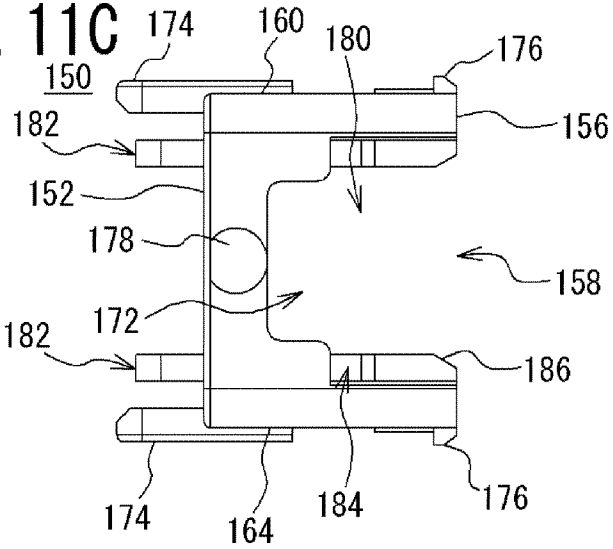
FIG. 11C is a side view as viewed from one side.
Figure 11D:
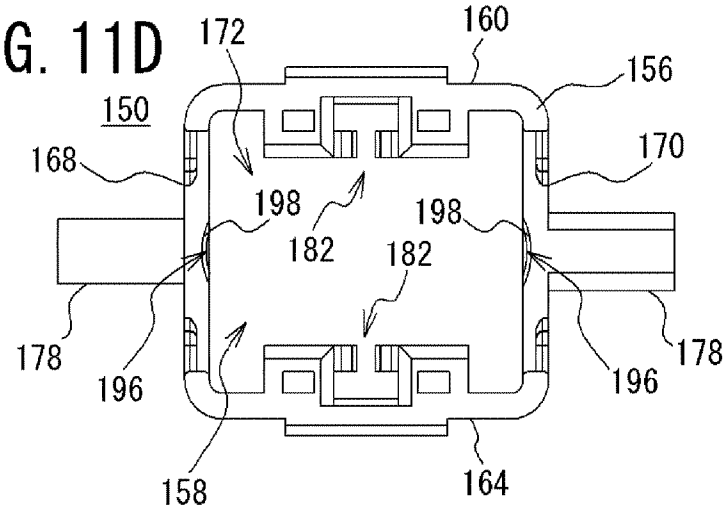
FIG. 11D is a rear view.
Figure 11A:
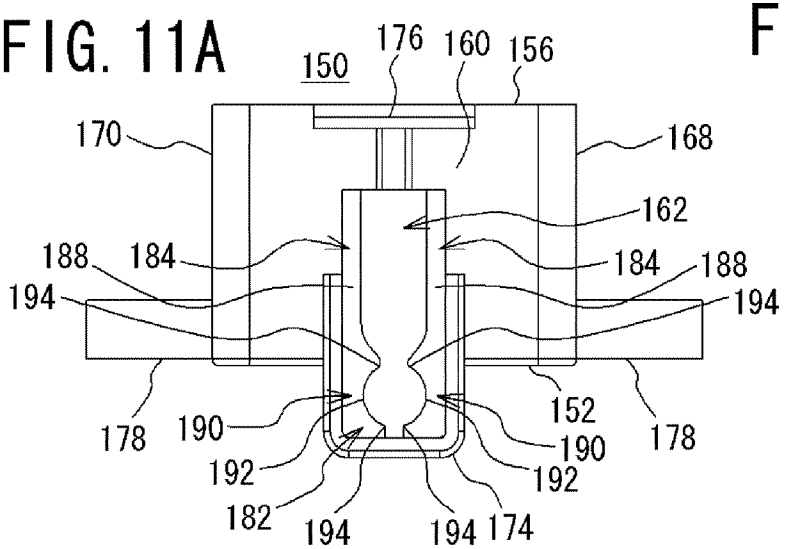
FIG. 11A is a plan view of the supporting member according to the embodiment.
Figure 11B:
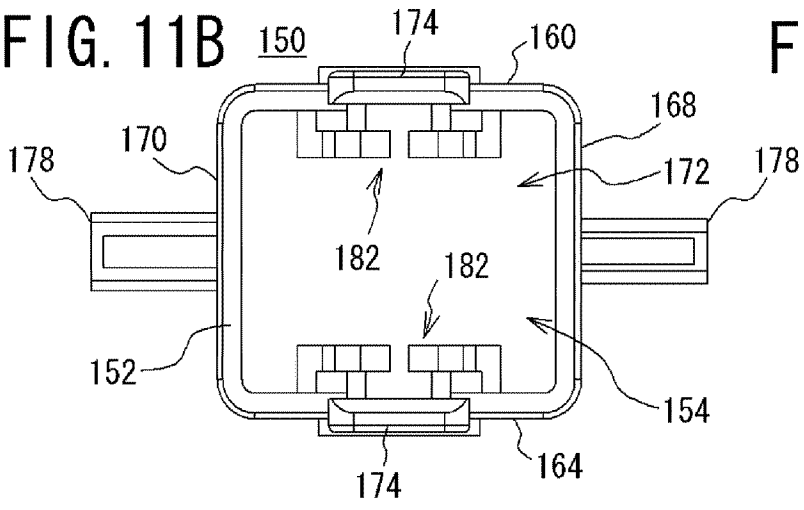
FIG. 11B is a front view.
Figure 12A:
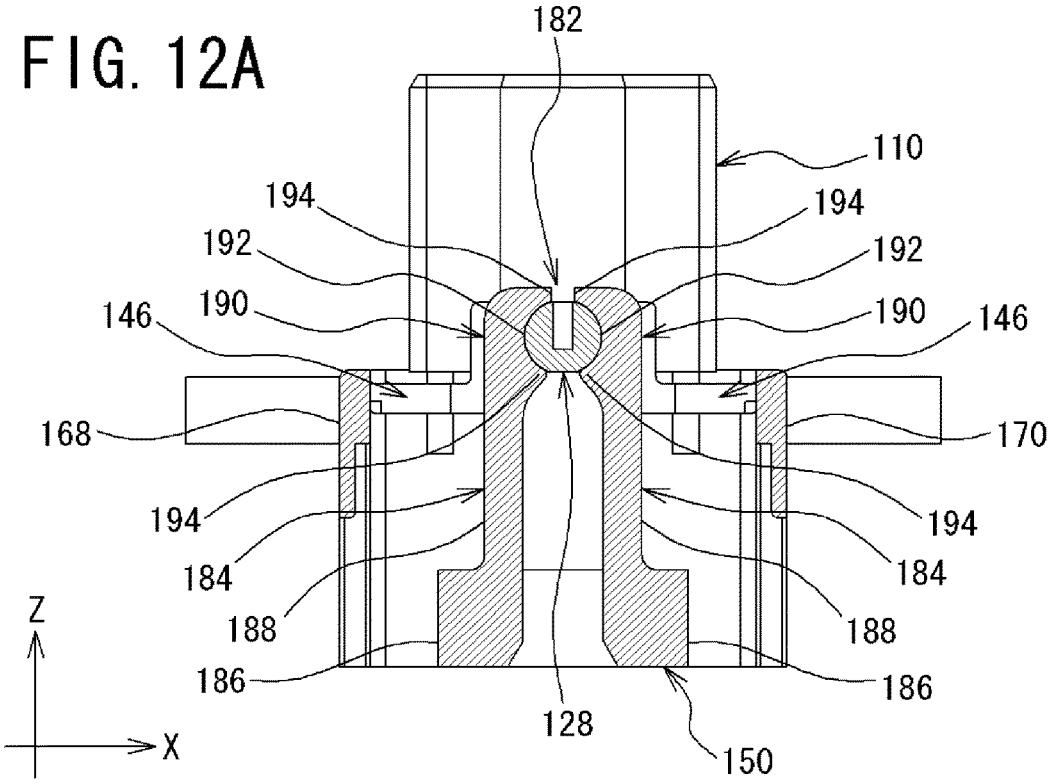
FIG. 12A is a cross-sectional view of XIIA-XIIA line in FIG. 5A.
Figure 12B:
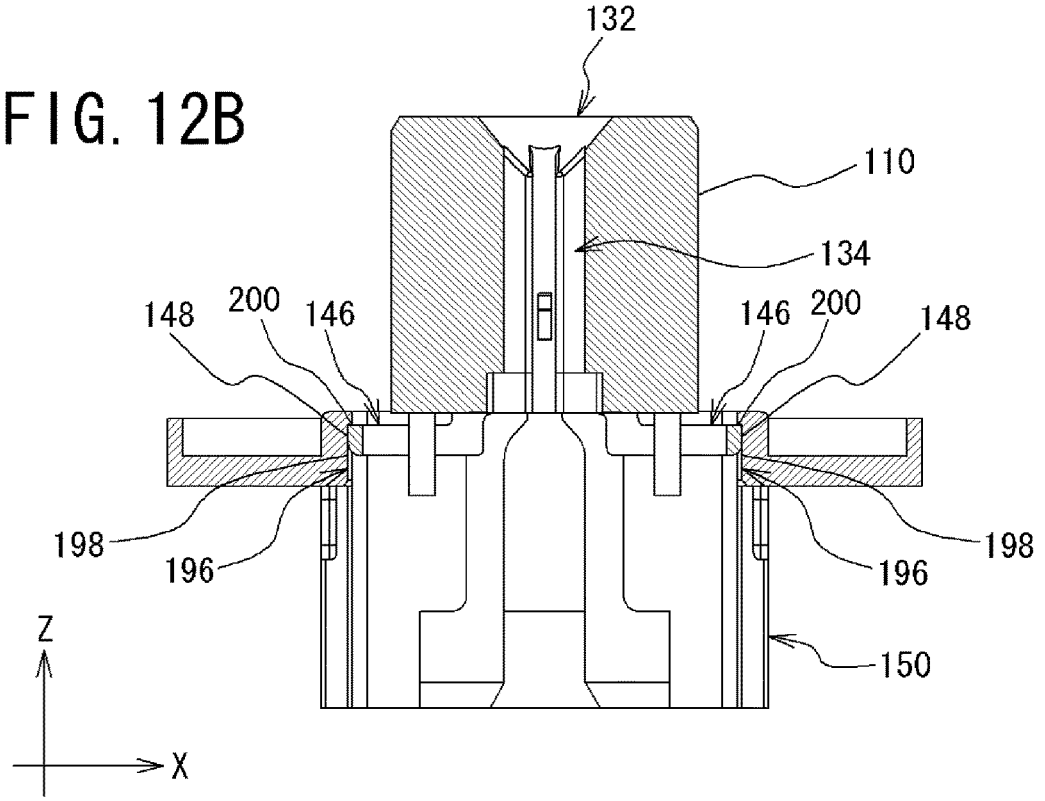
FIG. 12B is a cross-sectional view of XIIB-XIIB line in FIG. 5A.

First, the second contacts 68 are described with reference to FIGS. 7A to 7C. While a plurality of the second contacts 68 are provided, which are four second contacts 68 in this embodiment, one second contact 68 is described as a representative, since individual second contacts 68 are common.

The second contact 68 has a second contact body 70, an opening that is inserted with the first contact part 16 of the first contact 14 on one side of the second contact body 70, and a wire mounting part 74 that is mounted with a wire 108 on another side of the second contact body 70. The second contact 68 is formed by punching a metal plate and bending or the like. Inside the second contact body 70 is provided with a second contact part 90 that is contacted with the first contact part 16 of the first contact 14.

The second contact body 70 is formed with an opening 72 that is inserted with the first contact part 16 of the first contact 14, on one side, and cylindrically formed surrounded by an upper surface portion 78, a bottom surface portion 84, a one side-surface portion 86, and an another side-surface portion 88.

The wire mounting part 74 side of the upper surface portion 78 of the second contact body 70 is configured as a locking end 80 that is engaged with a claw-shaped lance 143 (see FIG. 9D) that is provided to a second contact container 130 formed inside the second housing 110 described later, and engagement of the lance 143 to the locking end 80 causes the second contact 68 to be positioned and fixed in the second contact container 130.

From an end part on the wire mounting part 74 side of the upper surface portion 78 of the second contact 68, a contact piece 82 formed with the second contact part 90 is extended toward inside the second contact body 70. This contact piece 82 is configured to be elasticity deformed around the wire mounting part 74 side of the upper surface portion 78 as an axis. Whereas, from an end part on the opening 72 side of the upper surface portion 78 of the second contact 68, there is formed a contact-piece protection part 92 that protects a tip of the extended contact piece 82, in a state being bent toward inside the second contact body 70.

On the one side-surface portion 86 side of the contact-piece protection part 92, there is formed a projection part 96 that is fitted into a hole part 94 formed on the one side-surface portion 86. Fitting of this projection part 96 into the hole part 94 causes the contact-piece protection part 92 to be fixed.

On the another side-surface portion 88 side of the contact piece 82, there is formed a regulation projection 100 that is fitted into a regulation hole 98 formed on the another side-surface portion 88. This regulation projection 100 is movable in the regulation hole 98. Fitting of this regulation projection 100 into the regulation hole 98 causes regulation of a range where the contact piece 82 is elasticity deformed and moved, and suppression of excessive movement of the contact piece 82, ensuring contact between the second contact part 90 formed on the contact piece 82, and the first contact 14.

On the bottom surface portion 84 side of a portion that is elasticity deformed in the contact piece 82, the second contact part 90 is formed to protrude, and this second contact part 90 is to be contacted with the first contact part 16 of the first contact 14.

There is formed a concave portion that is recessed toward inside from the bottom surface portion 84 of the second contact body 70. Forming of this concave portion causes a convex portion 104 to be formed inside the second contact body 70. This convex portion 104 is formed at a portion opposed to the second contact part 90, and the convex portion 104 is to press the inserted first contact 14 toward the second contact part 90 side.

The one side-surface portion 86 of the second contact body 70 is formed with the hole part 94 that is inserted with the projection part 96 formed on the contact-piece protection part 92 described above.

The another side-surface portion 88 of the second contact body 70 is formed with the regulation hole 98 that is inserted with the regulation projection 100 formed on the contact piece 82 described above. This regulation hole 98 is formed larger than the regulation projection 100 in which the regulation projection 100 is movable.

The another side-surface portion 88 is also formed with a protruding guide projection 106. This guide projection 106 is guided by the guide groove 142 formed in the second contact container 130 of the second housing 110 described later, and is a part to guide insertion of the second contact 68.

The wire mounting part 74 has a plurality of mounting pieces 76 that are connected when mounted with the wire 108. Then, folding of the mounting pieces 76 causes the wire 108 to be mounted to the second contact 68. Some of the mounting pieces 76 are mounted to a conductive electric wire portion of the wire, and some are mounted to an insulating resin portion that covers the electric wire.

Next, the second housing 110 is described with reference mainly to FIGS. 8A to 9D. The second housing 110 is a block body having a substantially rectangular parallelepiped shape, and includes a second front surface 112 formed with an insertion part 114 that is inserted with the first contact 14 of the first connector member 12, and a guide hole 132 that is inserted with the guide pin 46 formed in the first housing 20; a second rear surface 116 formed with an insertion hole 118 that is inserted with the second contact 68; a second upper surface 120 and a second bottom surface 122 that each formed with a shaft pin 128 supported by the supporting member 150 described later; and a one second-side-surface 124 and an another second-side-surface 126. The second housing 110 is integrally formed of a resin material or the like.

The second rear surface 116 side of the second housing 110 is formed with a ring spring 146 as an elastic supporting member to be supported by the supporting member 150, on each of the one second-side-surface 124 side and the another second-side-surface 126 side.

Inside the second housing 110 is formed with the second contact container 130 that contains the second contact 68, and a guide-pin guiding part 134 in which the guide pin 46 of the first housing 20 is inserted and guided.

The second front surface 112 of the second housing 110 is to be a surface on a side adjacent to the first housing 20 of the fitted first connector member 12, and is formed with a plurality of insertion parts 114 to be inserted with the first contacts 14, on each of the one second-side-surface 124 side and the another second-side-surface 126 side. In the embodiment, two insertion parts 114 are formed on each of the sides, thus four of them are formed in total. Each corner of the insertion parts 114 on a side to be inserted with the first contact 14 is chamfered for easier insertion. Each of the insertion parts 114 is coupled to the second contact container 130 of the second housing 110.

The guide hole 132 formed on the second front surface 112 is a part to be inserted with the guide pin 46 formed in the first housing 20. This guide hole 132 is formed in a conical shape reduced in diameter toward inside from the first front surface 24 side with an entrance side chamfered, and is configured such that the inserted guide pin 46 is introduced into the guide-pin guiding part 134.

The second rear surface 116 of the second housing 110 is formed with the insertion hole 118 that is inserted with the second contact 68 in assembling the second connector member 66. A plurality of the insertion holes 118 are formed on each of the one second-side-surface 124 side and the another second-side-surface 126 side, corresponding to the first contacts 14 to be connected. In the embodiment, two insertion holes 118 are formed on each of the sides, thus four of them are formed in total. The insertion hole 118 is formed with the guide groove 142, which is a part to guide the guide projection 106 formed on the second contact 68 when the guide projection 106 is inserted. The insertion hole 118 is coupled to the second contact container 130.

A substantially center portion of the second rear surface 116 is formed with a guide-pin protrusion hole 144 that is protruded with the guide pin 46 of the first housing 20, and coupled to the guide-pin guiding part 134 formed in the second housing 110.

The second rear surface 116 side of the second housing 110 is provided with the ring spring 146 as an elastic supporting member at positions opposed to each other on each of the one second-side-surface 124 side and the another second-side-surface 126 side, toward the supporting member 150 side.

This ring spring 146 is extended from each of substantially center portions on the second rear surface 116 sides of the second upper surface 120 and the second bottom surface 122, to the one second-side-surface 124 side and the another second-side-surface 126 side, and has a substantially oval shape having a curved surface portion 148 in which an extended end part side is formed into a curved surface shape and connected. Then, each of the curved surface portions 148 having an oval shape, on the one second-side-surface 124 side and the another second-side-surface 126 side is to be elastically deformably supported by the supporting member 150 described later.

A substantially cylindrical shaft pin 128 is erected on the second rear surface 116 side of each of the second upper surface 120 and the second bottom surface 122 of the second housing 110. The shaft pins 128 of the second upper surface 120 and the second bottom surface 122 are opposingly formed on a same axis toward the supporting member 150 side, and are parts to be supported by the supporting member 150 described later.

The second upper surface 120 and the second bottom surface 122 are formed to be raised in a curved surface shape along the guide-pin guiding part 134.

Inside the second housing 110 is formed with a plurality of the second contact containers 130, which are four second contact containers 130 in the embodiment, that each contain the second contact 68. Each of the second contact containers 130 is coupled to the insertion hole 118 formed on the second rear surface 116, and the second contact 68 is to be inserted from the insertion hole 118 and contained in the second contact container 130. Inside the second contact container 130 is formed with a claw-shaped lance 143 that is engaged to the locking end 80 formed to the second contact 68, and positions and fixes the second contact 68. The second contact container 130 is formed with the guide groove 142 that guides the guide projection 106 formed on the second contact 68.

The guide-pin guiding part 134 formed inside the second housing 110 is coupled to the guide hole 132 formed on the second front surface 112, and is a part in which the guide pin 46, of the first housing 20, that is inserted from the guide hole 132 is guided, introduced, and inserted inside. This guide-pin guiding part 134 has a shape corresponding to a shape of the guide pin 46, and formed in a cross-shaped groove in the embodiment.

The guide-pin guiding part 134 of the second housing 110 is formed with a lock projection 136 that is engaged with the lock part 52 formed on the guide pin 46 of the first housing 20 (see FIGS. 14A to 14D). This lock projection 136 is formed by an elastically deformable lock piece 138. When the guide pin 46 is inserted into the guide-pin guiding part 134, the lock part 52 of the guide pin 46 presses the lock projection 136, and the lock piece 138 is elastically deformed, enabling the lock part 52 to pass. After the lock part 52 passes the lock projection 136, the lock piece 138 returns to an original position with its elastic force, and the lock part 52 and the lock projection 136 are engaged and locked. An end part of the lock piece 138 is configured as an operation part 140 that can be pressed. The operation part 140 protrudes from the second rear surface 116 side of the second housing 110, and pressing of the operation part 140 causes movement of the lock piece 138, and enables disengagement of the lock part 52 and the lock projection 136, allowing the fitting of the first connector member 12 and the second connector member 66 to be released.

The second front surface 112 side of the second housing 110 is to be fitted into inside the guide-enclosing part 40 formed in the first housing 20, to be fitted to the first housing 20. Here, the guide-enclosing part 40 of the first housing 20 is to guide the one second-side-surface 124 and the another second-side-surface 126, as well as a part of the one second-side-surface 124 side and the another second-side-surface 126 side of the first upper surface 32 and the second bottom surface 122, of the second housing 110.

Next, the supporting member 150 is described with reference mainly to FIGS. 10A to 11D. The supporting member 150 is to be attached to a device or the like, while supporting the second housing 110 protruding from one side.

The supporting member 150 is a hollow cylindrical body surrounded by a front part provided with a front-side opening 154 through which the second housing 110 protrudes while being supported; a rear part 156 provided with a rear-side opening 158 that is inserted with the second housing 110 in assembling the second connector member 66; an upper part 160; an bottom part 164; a one side-part 168; and an another side-part 170. The supporting member 150 is integrally formed of a resin material.

Inside the supporting member 150 has a space part 172 surrounded by the upper part 160, the bottom part 164, the one side-part 168, and the another side-part 170. The space part 172 contains the second housing 110 inside, and is formed in a size allowing the second housing 110 to move when the second housing 110 is released from support of the supporting member 150. The space part 172 of the supporting member 150 is formed with the support claw 182 that supports the second housing 110. This support claw 182 is formed on each of the upper part 160 and the bottom part 164, corresponding to the shaft pins 128 formed on the second housing 110. Each of the support claws 182 is configured by a pair of claw pieces 184 so as to hold the shaft pin 128 formed on the second housing 110.

The front part 152 of the supporting member 150 is formed with the front-side opening 154 surrounded by each end-part side of the upper part 160, the bottom part 164, the one side-part 168, and the another side-part 170. The front part 152 is a part through which the supported second housing 110 is to protrude, and the support claws 182 that support the second housing 110 protrude from the upper part 160 side and the bottom part 164 side.

The rear part 156 of the supporting member 150 is formed with the rear-side opening 158, which is a part to be inserted with the second housing 110 in assembling the second connector member 66.

The upper part 160 and the bottom part 164 of the supporting member 150 are respectively formed with an upper open part 162 and a bottom open part 166, on the front part 152 side, in which a part of a center portion is opened. Each of these upper open part 162 and bottom open part 166 is configured such that the shaft pin 128, of the second housing 110, in a state being released from the support of the supporting member 150 can enter and move.

The front part 152 side of each of the upper open part 162 and the bottom open part 166 is formed so as to be protruded with a protecting frame 174 that surrounds the upper open part 162 and the bottom open part 166, from the front part 152. This protecting frame 174 protects each of the support claws 182 protruding from the front-side opening 154 from an external force, and reinforces the upper part 160 and the bottom part 164 formed with the upper open part 162 and the bottom open part 166.

The rear part 156 side of each of the upper part 160 and the bottom part 164 is formed with an attaching projection part 176 that is attached to a device or the like.

On the rear part 156 side of each of the one side-part 168 and the another side-part 170 of the supporting member 150, a cut portion 180 is formed so as to be connected with the rear-side opening 158 formed at the rear part 156. Then, on outside opposite to the space part 172, of the one side-part 168 and the another side-part 170, there is formed an attaching part 178 that has an erected columnar shape and is attached to a device or the like.

Inside of each the one side-part 168 and the another side-part 170 is formed with a supporting part 196 that supports the curved surface portion 148 of the ring spring 146 formed in the second housing 110. This supporting part 196 is provided at a substantially center portion of the one side-part 168 and the another side-part 170, and formed as a curved-surface concave portion 198 that is recessed in a curved surface shape, corresponding to a shape of the curved surface portion 148 of the ring spring 146. The front part 152 side of the curved-surface concave portion 198 is configured as an abutting part 200 that is abutted with the curved surface portion 148 of the ring spring 146.

Inside the supporting member 150 is formed with the support claws 182 that each support the shaft pin 128 formed each on the second upper surface 120 and the second bottom surface 122 of the second housing 110. The support claws 182 are formed opposed to each other inside the upper part 160 and the bottom part 164, and each of the support claws 182 is configured by the pair of claw pieces 184 such that the pair of claw pieces 184 hold the shaft pin 128. While the support claws 182 are symmetrically formed, one support claw 182 is described as a representative, since the configuration is common.

Each of the pair of claw pieces 184 that configure the support claw 182 is formed with a pair of claw-piece bases 186 that are on the rear part 156 side and protrude to the space part 172 side of the supporting member 150; claw-piece arms 188 that each are extended from each of the claw-piece bases 186 toward the front part 152 side; and holding parts 190 that support the shaft pin 128 of the second housing 110 on tip sides of the claw-piece arms 188, namely, on the front part 152 side.

Each of the holding parts 190 has a recessed portion 192 that is recessed in a circular shape on an opposed side of the individual claw pieces 184 so as to be able to support the cylindrical shaft pin, and a pair of holding projection parts 194 are protruded and formed on both sides of each the recessed portion 192. Then, the shaft pin 128 is disposed between the holding parts 190 of the pair of claw pieces 184, and held by the recessed portions 192 and the pair of holding projection parts 194 of the holding parts 190, to be supported.

The support claw 182 can be moved in an extending direction of the shaft pin 128 while the shaft pin 128 is held by the recessed portions 192 and the pair of holding projection parts 194 of the holding parts 190. Additionally, the support claw 182 is to be elastically deformed about the claw-piece base 186 as an axis. Thus, the support claw 182 is elastically deformed while holding the shaft pin 128, enabling the movement of the second housing 110.

Next, assembly of the second connector member 66 is described with reference mainly to FIGS. 5A to 6D, 12A, and 12B. In assembling the second connector member 66, firstly, the second contact 68 mounted with the wire 108 in the wire mounting part 74 is mounted and contained in the second contact container 130 of the second housing 110. Here, from the opening 72 side, the second contact 68 is inserted into the insertion hole 118 of the second housing 110. Then, engagement of the lance 143 in the second contact container 130 with the locking end 80 of the inserted second contact 68 causes the second contact 68 to be positioned and fixed. During the insertion, the second contact 68 is inserted while the guide groove 142 formed in the second contact container 130 guides the guide projection 106 formed on the second contact 68.

Then the second housing 110 mounted with the second contact 68 is attached to the supporting member 150. In this attachment, from the rear-side opening 158 provided on the rear part 156 of the supporting member 150, the second front surface 112 side of the second housing 110 is firstly inserted; the shaft pin 128 formed each on the second upper surface 120 and the second bottom surface 122 of the second housing 110 is held by the holding parts 190 of the support claw 182 of the supporting member 150; and the curved surface portion 148 of the ring spring 146 of the second housing 110 is supported by the supporting part 196 formed inside of each the one side-part 168 and the another side-part 170 of the supporting member 150.

Here, the shaft pin 128 of the second housing 110 enters into the recessed portion 192 of the holding part 190 of the support claw 182, and is held and supported by the pair of claw pieces 184 while being disposed between the pair of holding projection parts 194. The curved surface portion 148 of the ring spring 146 of the second housing 110 is supported so as to be fitted into the curved-surface concave portion 198 of the supporting part 196, and an end part of the ring spring 146 is abutted to the abutting part 200 of the curved-surface concave portion 198 of the supporting part 196. Here, since the curved surface portion 148 of the ring spring 146 formed in the second housing 110 is abutted to the abutting part 200 formed on the front part 152 side of the curved-surface concave portion 198 of the supporting part 196 of the supporting member 150, the second housing 110 is prevented from being inclined when supported, and maintained at an initial position to be fitted (see FIG. 16C).

The second housing 110 and the supporting member 150 of the assembled second connector member 66 is configured such that, in a state where the shaft pin 128 formed on the second housing 110 is held by the holding parts 190 of the support claw 182 formed in the supporting member 150, the ring spring 146 formed in the second housing 110 is held by the curved-surface concave portion 198 of the supporting part 196 formed in the supporting member 150.

Figure 13A:
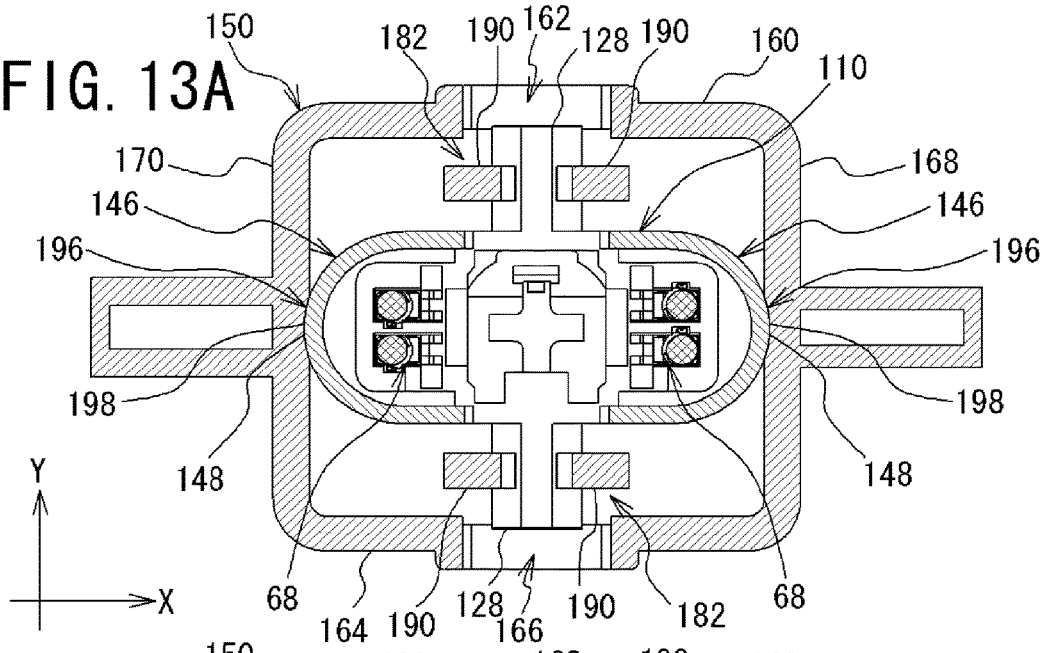
FIG. 13A is a cross-sectional view of XIIIA-XIIIA line in FIG. 5A.
Figure 13B:
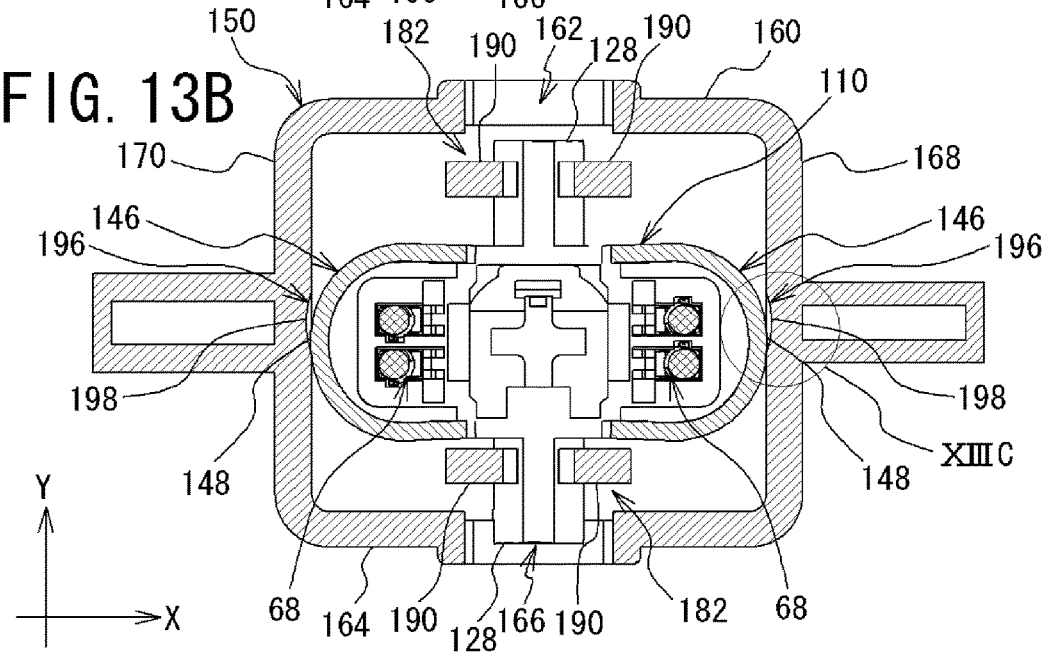
FIG. 13B is a cross-sectional view corresponding to FIG. 13A and illustrating a state where the second housing has moved.
Figure 13C:
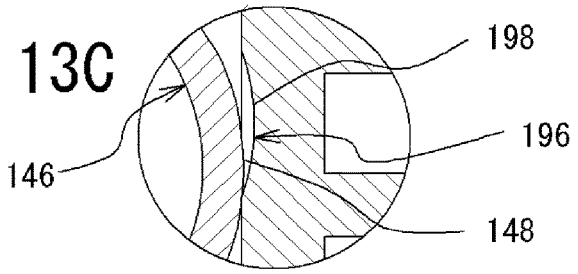
FIG. 13C is an enlarged view of XIIIC portion in FIG. 13B.

As illustrated in FIGS. 13A to 13C, when the second housing 110 and the supporting member 150 are assembled, the curved surface portion 148 of the ring spring 146 of the second housing 110 is fitted to the curved-surface concave portion 198 of the supporting part 196 of the supporting member 150, thus the curved surface portion 148 is fitted into the curved-surface concave portion 198, enabling positioning at a predetermined position. At this time, the second housing 110 can be moved about the shaft pin 128 held by the support claw 182 of the supporting member 150, as an axis.

Thus, while being supported by the supporting member 150, the second housing 110 can be moved in X-axis direction (horizontal direction) of the supporting member 150, namely, the one side-part 168 side and the another side-part 170 side of the supporting member 150, by elastic deformation of the support claw 182, and the ring spring 146 of the second housing 110.

Additionally, while the shaft pin 128 is held by the holding parts 190 of the support claw 182 of the supporting member 150, the second housing 110 can be moved in Y-axis direction (vertical direction), namely, the upper part 160 side and the bottom part 164 side of the supporting member 150. Here, the ring spring 146 can be elastically deformed.

Combining a moving direction of the shaft pin 128 of the second housing 110 and the support claw 182 of the supporting member 150, and a moving direction of the ring spring 146 of the second housing 110 and the supporting part 196 of the supporting member 150 enables movement in an oblique direction with respect to X-axis direction and Y-axis direction. It is also possible to move rotationally about the shaft pin 128 as an axis by elastically deforming the ring spring 146, move rotationally about the curved surface portion 148 of the ring spring 146 as an axis by elastically deforming the support claw 182 that supports the shaft pin 128, and also move rotationally about the guide-pin guiding part 134 of the second housing 110 as an axis by elastically deforming the ring spring 146 and the support claw 182. Thus, even when the fitting axes of the first connector member and the second connector member are misaligned or inclined, the fitting axes can be adjusted.

The second housing 110 can also be moved in Z-axis direction (front-back direction), namely, from the front part 152 side to the rear part 156 side of the supporting member 150, by releasing the shaft pin 128 from holding by the support claw 182 of the supporting member 150.

The support claw of the supporting member 150 that holds the shaft pin 128 of the second housing 110 is configured such that, the holding is maintained when the first connector member 12 is fitted, and when receiving a larger stress than that of during the fitting, after the fitting, the support claw 182 is elastically deformed about the claw-piece base 186 as an axis, in a direction to which both the claw pieces 184 are opened, and then the holding of the shaft pin 128 is released.

Next, the fitting of the first connector member 12 and the second connector member 66 is described with reference mainly to FIGS. 14A to 20C. The connector 10 of the embodiment is configured such that, even when the fitting axes of the first connector member 12 and the second connector member 66 are misaligned or inclined, fitting is performed with the misalignment or an inclination adjusted, and when a large force is applied in a fitting direction, it is possible to suppress occurrence of a failure such as breakage of the first connector member 12 and the second connector member 66.

[Without misalignment or inclination in fitting axes] First, the fitting when there is no misalignment, inclination, or the like in the fitting axes of the first connector member 12 and the second connector member 66 is described with reference mainly to FIGS. 14A to 14D.

In fitting without any misalignment in the fitting axes of the first connector member 12 and the second connector member 66, firstly, the first connector member 12 and the second connector member 66 are brought closer with both the fitting axes being substantially linear as illustrated in FIGS. 14A and 14C, and the guide pin 46 of the first housing 20 of the first connector member 12 is inserted into the guide hole 132 of the second housing 110 of the second connector member 66. Here, each the cross-shaped guide piece 48 formed on the guide pin 46 is guided by the guide-pin guiding part 134 formed in a cross-shaped recess, during the insertion.

As the insertion is continued, the guide-enclosing part 40 formed in the first housing 20 of the first connector member 12 is to be inserted while guiding an outer circumference of the second front surface 112 side of the second housing 110 of the second connector member 66, namely, the second upper surface 120, the second bottom surface 122, the one second-side-surface 124, and the another second-side-surface 126.

From each of the insertion parts 114 formed on the second front surface 112 of the second housing 110, the first contact part 16 of each of the first contacts 14 of the first connector member 12 is also inserted. Here, each of the first contacts 14 is inserted from the opening 72 of the second contact 68 contained in the second contact container 130 inside the second housing 110 (see FIGS. 7A to 7C), and the first contact part 16 of each of the first contacts 14 is contacted and conducted with the second contact part 90 of the second contact 68.

Then, the lock part 52 formed in the guide pin 46 of the first housing 20 of the first connector member 12 is engaged to the lock projection 136 formed inside the guide-pin guiding part 134 of the second housing 110 of the second connector member 66, causing the first connector member 12 and the second connector member 66 to be locked (see FIGS. 14B and 14D). Thus, the fitting of the first connector member 12 and the second connector member 66 is completed.

For releasing the fitting of the first connector member 12 and the second connector member 66, by pressing the operation part 140 of the lock piece 138 formed in the guide-pin guiding part 134 on the second rear surface 116 side of the second housing 110, the lock piece 138 is elastically deformed to move the lock projection 136, and the engagement with the lock part 52 of the guide pin 46 is released, enabling detachment of the first connector member 12 and the second connector member 66.

[Misalignment in X-axis direction] Next, the fitting when the fitting axes of the first connector member 12 and the second connector member 66 are misaligned in X-axis direction (horizontal direction) is described with reference mainly to FIGS. 15A to 15C.

Figures 15A, 15B, 15C:
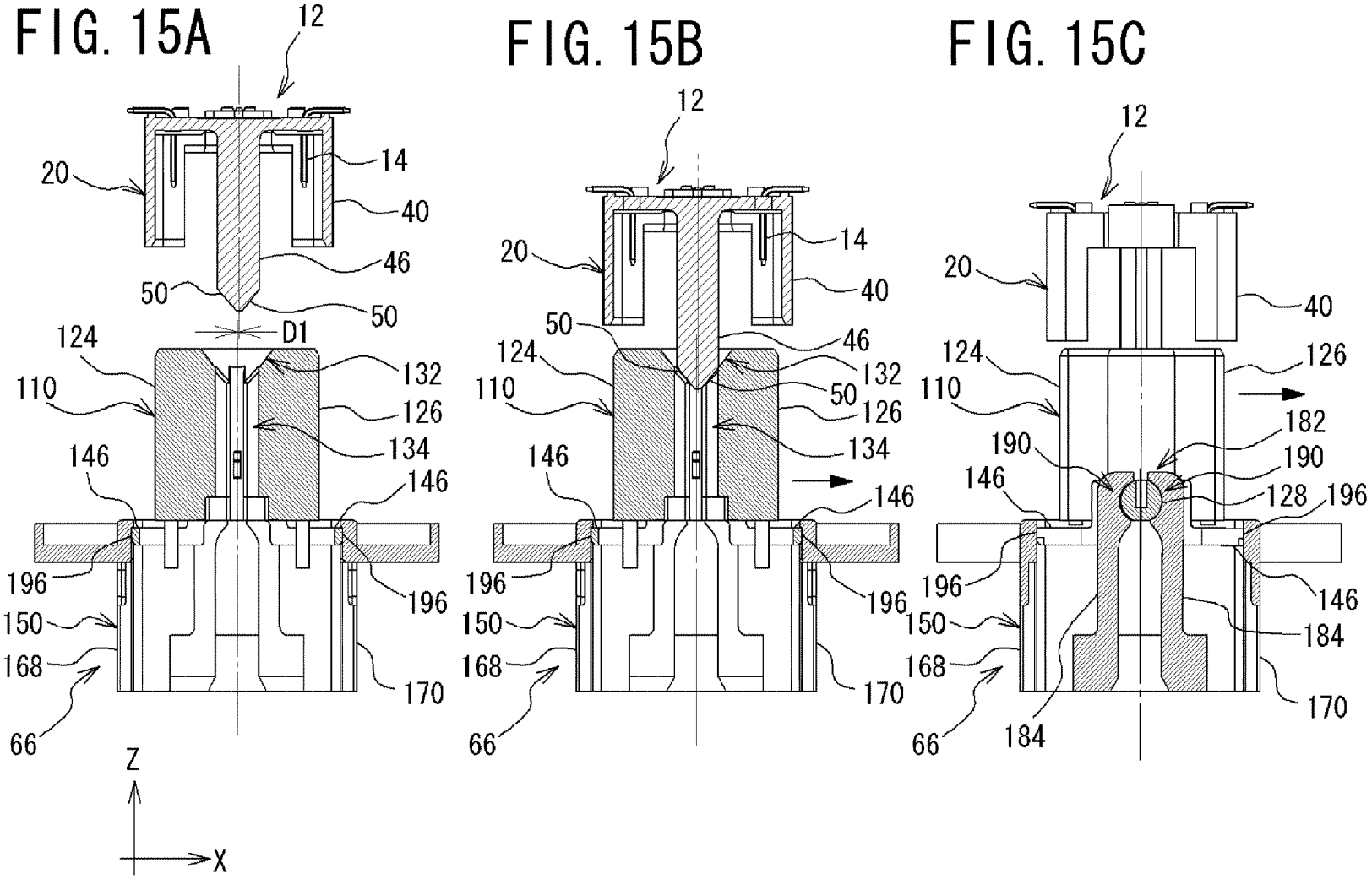
FIG. 15A is a cross-sectional view corresponding to FIG. 14C and explaining fitting when fitting axes of the first connector member and the second connector member are misaligned in X-axis direction.
FIG. 15B is a cross-sectional view following FIG. 15A.
FIG. 15C is a cross-sectional view corresponding to FIG. 12A and explaining fitting.

The case where the fitting axes of the first connector member 12 and the second connector member 66 are misaligned in X-axis direction is, as illustrated in FIG. 15A, when the fitting is performed with the fitting axis of the second connector member 66 and the fitting axis of the first connector member 12 misaligned in X-axis direction (horizontal direction). In the embodiment, it is a state where the first connector member 12 is misaligned toward the another second-side-surface 126 side of the second housing 110 by distance D1.

When the fitting is started with the fitting axes of the first connector member 12 and the second connector member 66 misaligned in X-axis direction, firstly, from a state illustrated in FIG. 15A, the guide pin 46 formed in the first housing 20 of the first connector member 12 is inserted into the guide hole 132 of the second housing 110 of the second connector member 66. Here, although the tapered portion 50 formed at the tip side of the guide pin 46 is abutted to the guide hole 132 while being misaligned in X-axis direction, since an entrance of the guide hole 132 is formed in the chamfered conical shape, the guide hole 132 is pressed in accordance with the insertion of the guide pin 46, as illustrated in FIG. 15B. Then, when the guide pin 46 presses the guide hole 132, the second housing 110 is moved to the another side-part 170 side of the supporting member 150, the guide pin 46 and the guide-pin guiding part 134 are positioned to be fittable, and the misalignment of the fitting axes is adjusted (see FIG. 15C).

In this movement of the second housing 110 when the fitting axes are misaligned in X-axis direction, the guide hole 132 of the second housing 110 is pressed by the guide pin 46 of the first housing 20 to the one side-part 168 side of the supporting member 150, so that the ring spring 146 formed in the second housing 110 is elastically deformed, and the support claw 182 that supports the shaft pin 128 of the second housing 110 is also elastically deformed; and the second housing 110 is moved inside the supporting member 150 to the another side-part 170 side.

Then, the misalignment of the fitting axes of the first connector member 12 and the second connector member 66 is adjusted, enabling fitting of the first connector member 12 and the second connector member 66. Moreover, the fitting of the first connector member 12 and the second connector member 66 is performed in a same way as when there is no above-described misalignment or the like in the fitting axes (see FIGS. 14A to 14D).

[X-Axis Inclination]

Next, the fitting when the fitting axes of the first connector member 12 and the second connector member 66 are inclined in X-axis direction (horizontal direction) is described with reference mainly to FIGS. 16A to 16D.

Figures 16A, 16B, 16C, 16D:
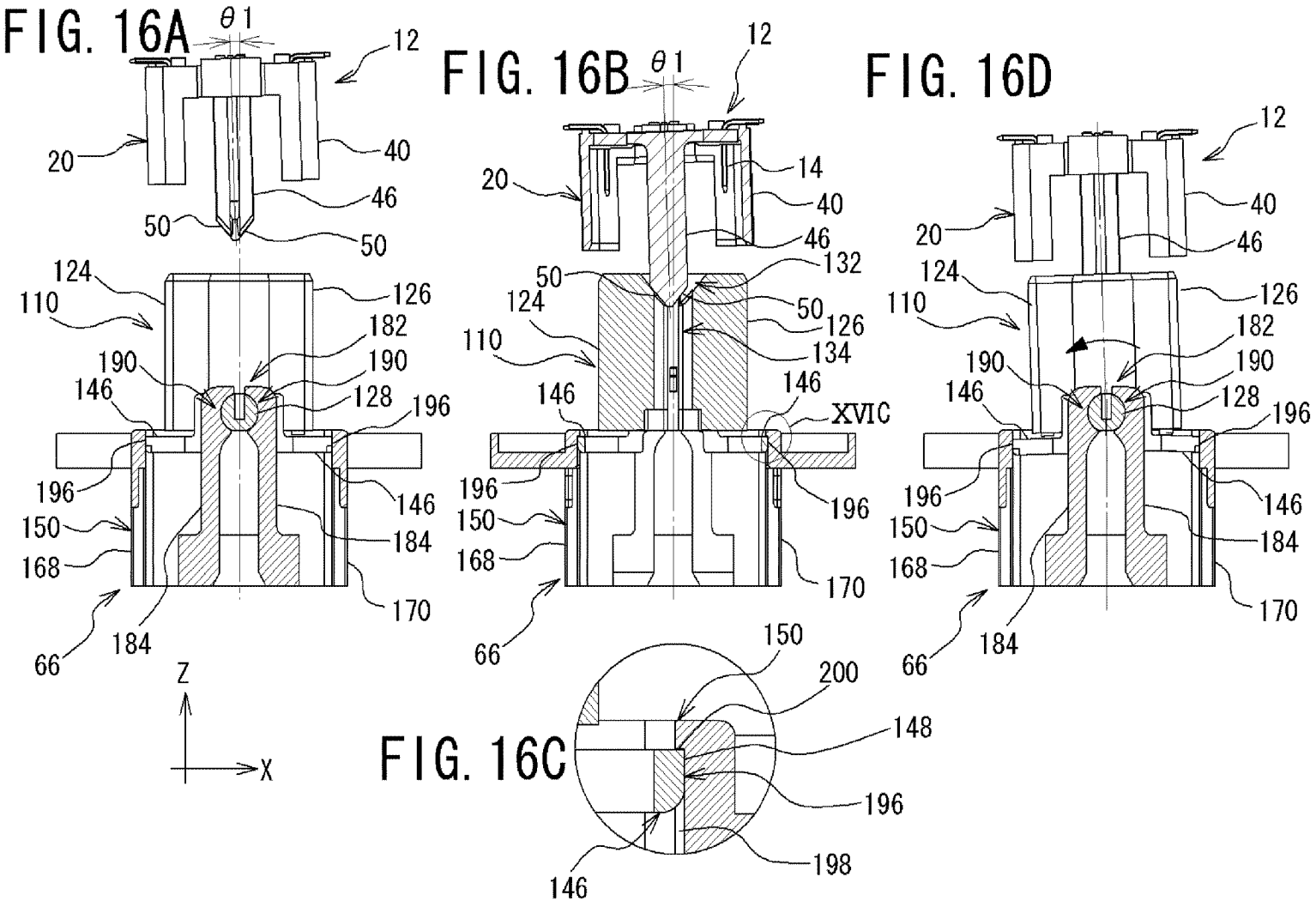
FIG. 16A is a cross-sectional view corresponding to FIG. 12A and explaining fitting when the fitting axes of the first connector member and the second connector member are inclined in X-axis direction.
FIG. 16B is a cross-sectional view corresponding to FIG. 14C and explaining fitting.
FIG. 16C is an enlarged view of XVIC portion in FIG. 16B.
FIG. 16D is a cross-sectional view following FIG. 16A.

The case where the fitting axes of the first connector member 12 and the second connector member 66 are inclined in X-axis direction is, as illustrated in FIG. 16A, when the first connector member 12 is disposed while being inclined by angle θ1 with respect to the second connector member 66, and the fitting is started in this state where the fitting axes are inclined.

When the fitting is started with the fitting axes of the first connector member 12 and the second connector member 66 inclined in X-axis direction, firstly, from a state illustrated in FIG. 16A, the guide pin 46 formed in the first housing 20 of the first connector member 12 is inserted into the guide hole 132 of the second housing 110 of the second connector member 66.

Here, as illustrated in FIG. 16B, although the tapered portion 50 formed at the tip side of the guide pin 46 is abutted to the guide hole 132 while being inclined, since an entrance of the guide hole 132 is formed in the chamfered conical shape, the guide hole 132 is pressed in accordance with the insertion of the guide pin 46, and the pressing causes the second housing 110 to be moved in a direction where the guide pin 46 can be fitted with the guide-pin guiding part 134, adjusting the inclination of the fitting axes (see FIG. 16D).

In this movement of the second housing 110, the guide pin 46 of the first housing 20 presses the guide hole 132 of the second housing 110, so that the second housing 110 is rotated about the shaft pin 128, as an axis, that is held by the holding parts 190 of the support claw 182 of the supporting member 150, to the direction where the first connector member 12 is fitted.

Then, the inclination of the fitting axes of the first connector member 12 and the second connector member 66 is adjusted, enabling fitting of the first connector member 12 and the second connector member 66. Moreover, the fitting of the first connector member 12 and the second connector member 66 is performed in a same way as when there is no above-described inclination or the like in the fitting axes (see FIGS. 14A to 14D).

[Misalignment in Y-Axis Direction]

Next, the fitting when the fitting axes of the first connector member 12 and the second connector member 66 are misaligned in Y-axis direction (vertical direction) is described with reference mainly to FIGS. 17A to 17C.

Figure 17A:
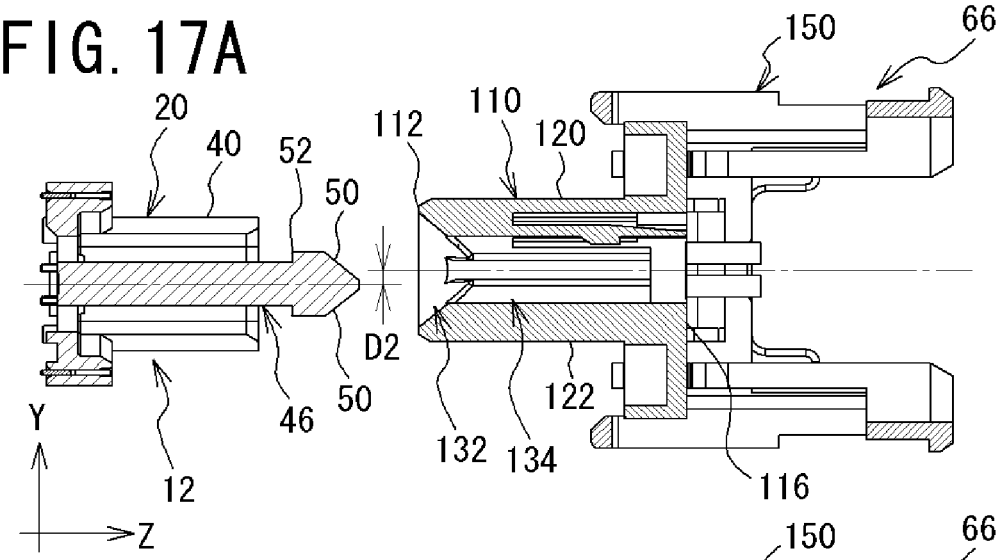
FIG. 17A is a cross-sectional view corresponding to FIG. 14A and explaining fitting when the fitting axes of the first connector member and the second connector member are misaligned in Y-axis direction.
Figure 17B:
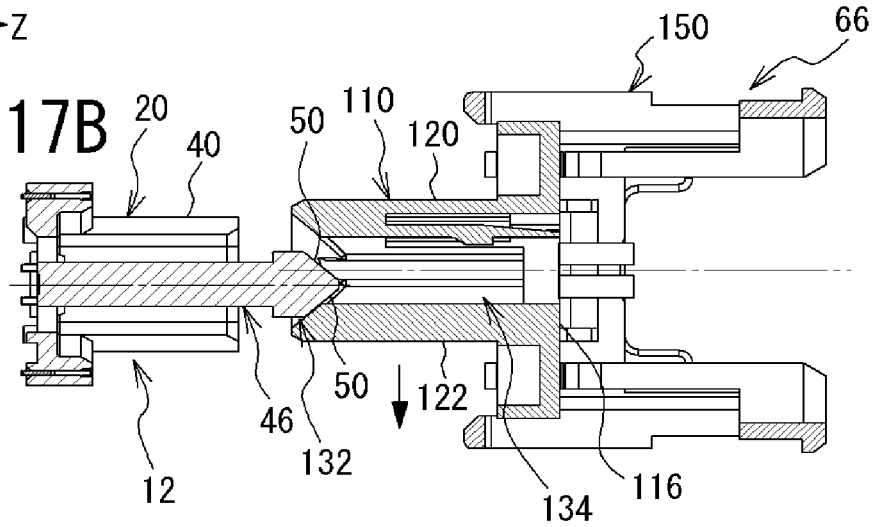
FIG. 17B is a cross-sectional view following FIG. 17A.
Figure 17C:
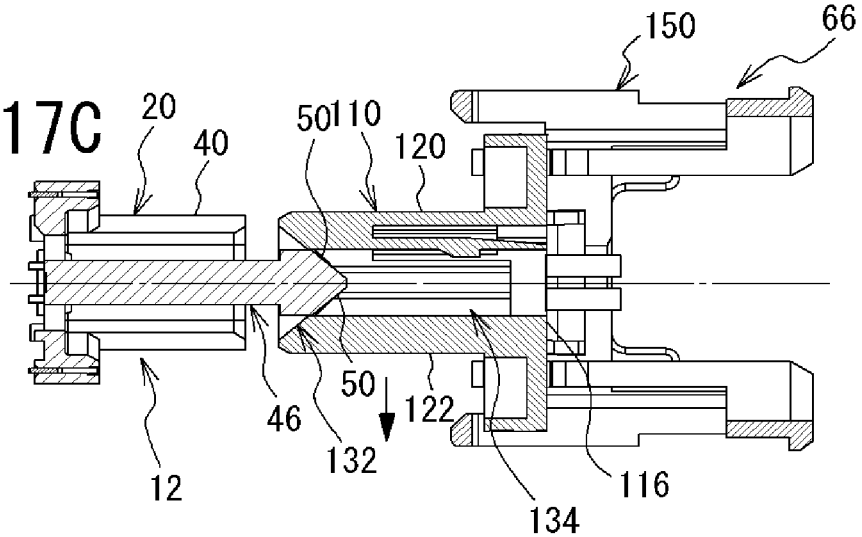
FIG. 17C is a cross-sectional view following FIG. 17B.

The case where the fitting axes of the first connector member 12 and the second connector member 66 are misaligned in Y-axis direction is, as illustrated in FIG. 17A, when the fitting is performed while the fitting axis of the first connector member 12 is misaligned in Y-axis direction (horizontal direction) with respect to the fitting axis of the second connector member 66. In the embodiment, it is a state where the first connector member 12 is misaligned toward the second bottom surface 122 side of the second housing 110 by distance D2.

When the fitting is started with the fitting axes of the first connector member 12 and the second connector member 66 misaligned in Y-axis direction, firstly, from a state illustrated in FIG. 17A, the guide pin 46 formed in the first housing 20 of the first connector member 12 is inserted into the guide hole 132 of the second housing 110 of the second connector member 66. Here, as illustrated in FIG. 17B, although the tapered portion 50 formed at the tip side of the guide pin 46 is abutted to the guide hole 132 while being misaligned in Y-axis direction, since an entrance of the guide hole 132 is formed in the chamfered conical shape, the guide hole 132 is pressed in accordance with the insertion of the guide pin 46. Then, when the guide pin 46 presses the guide hole 132, the second housing 110 is moved to the bottom part 164 side of the supporting member 150, the guide pin 46 and the guide-pin guiding part 134 are positioned to be fittable, and the misalignment of the fitting axes is adjusted (see FIG. 17C).

In this movement of the second housing 110 when the fitting axes are misaligned in Y-axis direction, the guide hole 132 of the second housing 110 is pressed by the guide pin 46 of the first housing 20 to the bottom part 164 side of the supporting member 150, so that the shaft pin 128 formed on the second housing 110 is moved in Y-axis direction, which is toward the bottom part 164 side (downward direction) in the embodiment, while being held by the holding parts 190 of the support claw 182 of the supporting member 150.

Here, as illustrated in the FIGS. 13B and 13C, the curved surface portion 148 of the ring spring 146 of the second housing 110 is in a state being detached from the curved-surface concave portion 198 of the supporting part 196 of the supporting member 150, in response to the movement of the second housing 110.

Then, the misalignment of the fitting axes of the first connector member 12 and the second connector member 66 is adjusted, enabling fitting of the first connector member 12 and the second connector member 66. Moreover, the fitting of the first connector member 12 and the second connector member 66 is performed in a same way as when there is no above-described misalignment or the like in the fitting axes (see FIGS. 14A to 14D).

[Y-axis inclination] Next, the fitting when the fitting axes of the first connector member 12 and the second connector member 66 are inclined in Y-axis direction (vertical direction) is described with reference mainly to FIGS. 18A to 18C.

Figure 18A:
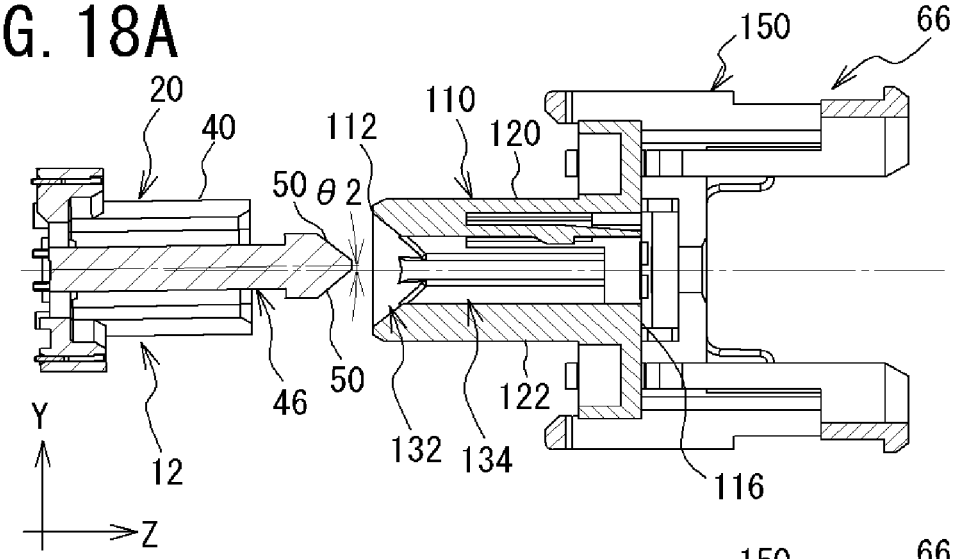
FIG. 18A is a cross-sectional view corresponding to FIG. 14A and explaining fitting when the fitting axes of the first connector member and the second connector member are inclined in Y-axis direction.

The case where the fitting axes of the first connector member 12 and the second connector member 66 are inclined in Y-axis direction is, as illustrated in FIG. 18A, when the first connector member 12 is disposed while being inclined by angle θ2 with respect to the second connector member 66, and the fitting is started in this state where the fitting axes are inclined.

When the fitting is started with the fitting axes of the first connector member 12 and the second connector member 66 inclined in Y-axis direction, firstly, from a state illustrated in FIG. 18A, the guide pin 46 formed in the first housing 20 of the first connector member 12 is inserted into the guide hole 132 of the second housing 110 of the second connector member 66.

Figure 18B:
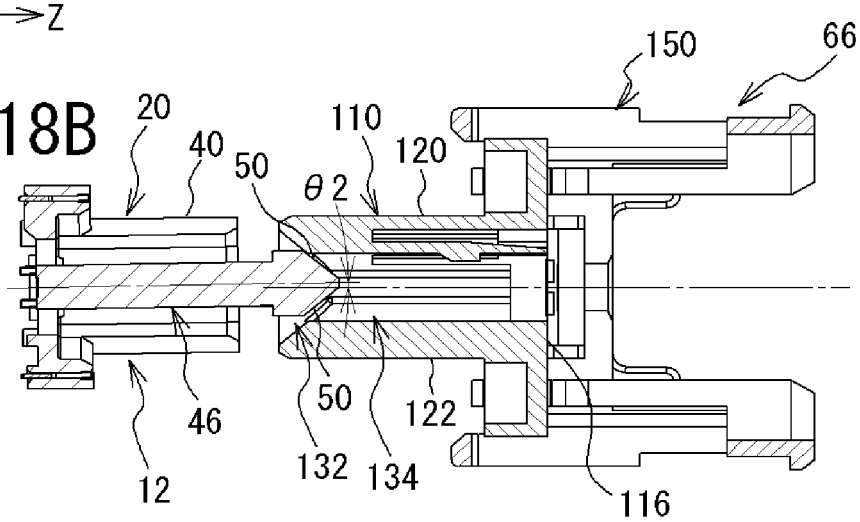
FIG. 18B is a cross-sectional view following FIG. 18A.
Figure 18C:
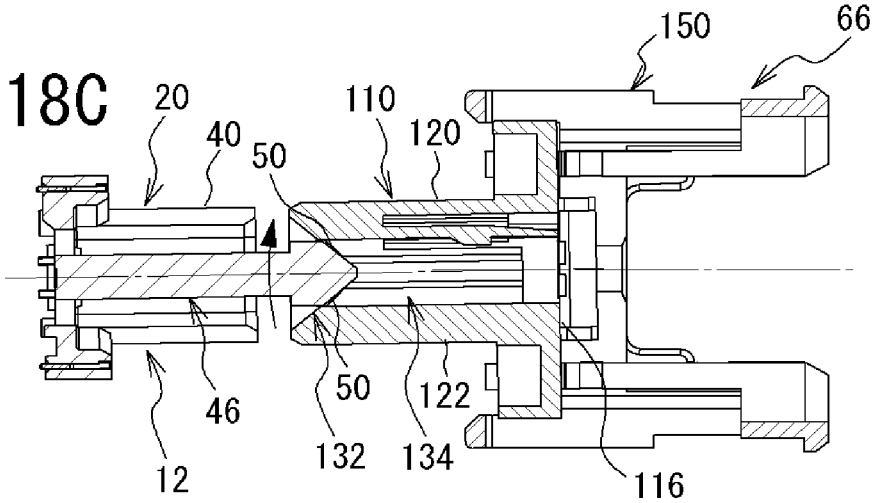
FIG. 18C is a cross-sectional view following FIG. 18B.

Here, as illustrated in FIG. 18B, although the tapered portion 50 formed at the tip side of the guide pin 46 is abutted to the guide hole 132 while being inclined, since an entrance of the guide hole 132 is formed in the chamfered conical shape, the guide hole 132 is pressed in accordance with the insertion of the guide pin 46, and the pressing causes the second housing 110 to be moved in a direction where the guide pin 46 can be fitted with the guide-pin guiding part 134, adjusting the inclination of the fitting axes (see FIG. 18C).

In this movement of the second housing 110, the guide pin 46 of the first housing 20 presses the guide hole 132 of the second housing 110, so that the second housing 110 is rotated about the curved surface portion 148 of the ring spring 146 as an axis, while being supported by the curved-surface concave portion 198 of the supporting part 196 of the supporting member 150. Here, although the shaft pin 128 of the second housing 110 is inclined in accordance with inclination of the second housing 119, elastic deformation of the support claw 182 of the supporting member 150 allows the shaft pin 128 to be inclined.

Then, the inclination of the fitting axes of the first connector member 12 and the second connector member 66 is adjusted, enabling fitting of the first connector member 12 and the second connector member 66. Moreover, the fitting of the first connector member 12 and the second connector member 66 is performed in a same way as when there is no above-described inclination or the like in the fitting axes (see FIGS. 14A to 14D).

[Rotational direction misalignment] Next, the fitting when the fitting axes of the first connector member 12 and the second connector member 66 are misaligned in a rotational direction is described with reference to FIGS. 19A to 19C.

Figure 19C:
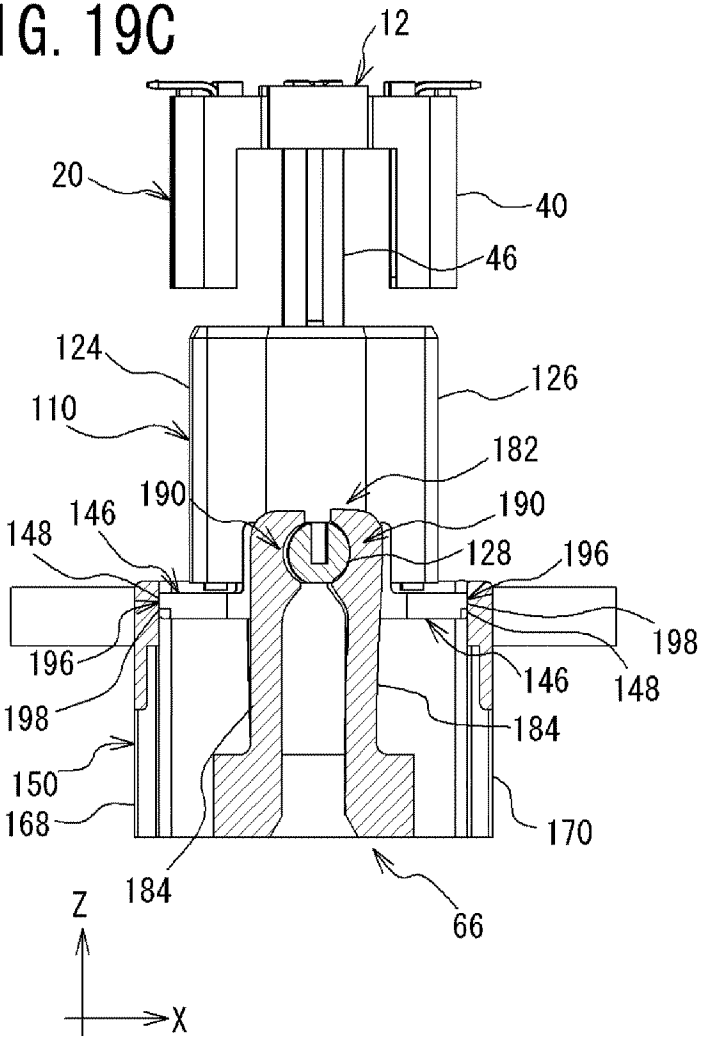
FIG. 19C is a cross-sectional view corresponding to FIG. 12A and explaining fitting.
Figure 19A:
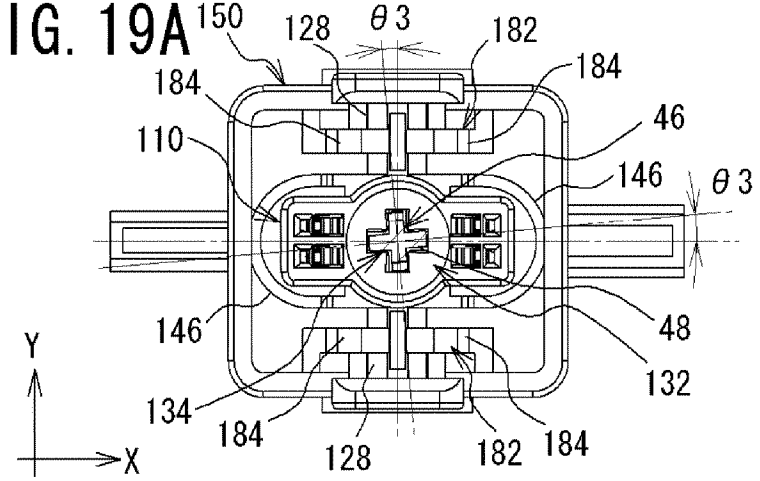
FIG. 19A is a cross-sectional view corresponding to the cross section of XIXA-XIXA line in FIG. 1B and explaining fitting when the fitting axes of the first connector member and the second connector member are misaligned in a rotational direction.

The case where the fitting axes of the first connector member 12 and the second connector member 66 are misaligned in the rotational direction is, as illustrated in FIG. 19A, a state where the fitting axis of the first connector member 12 is misaligned in the rotational direction with respect to the fitting axis of the second connector member 66. It is a state where the first housing 20 of the first connector member 12 is misaligned in the rotational direction by angle θ3 with respect to the second housing 110 of the second connector member 66, in the embodiment.

Figure 1B:
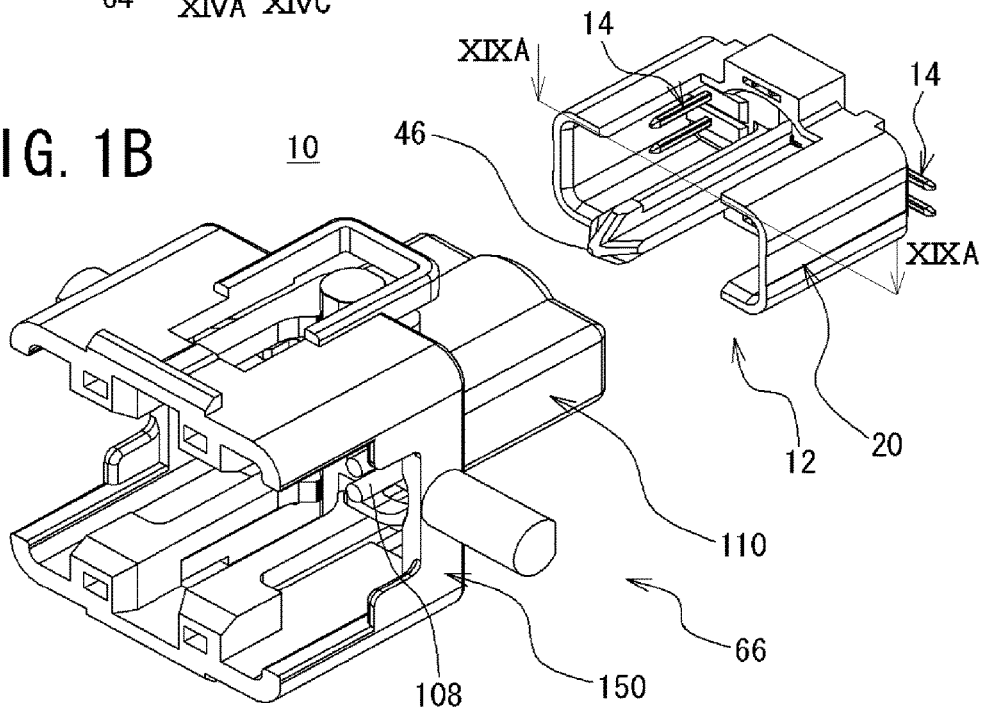
FIG. 1B is a perspective view as viewed from another side.
Figure 2:
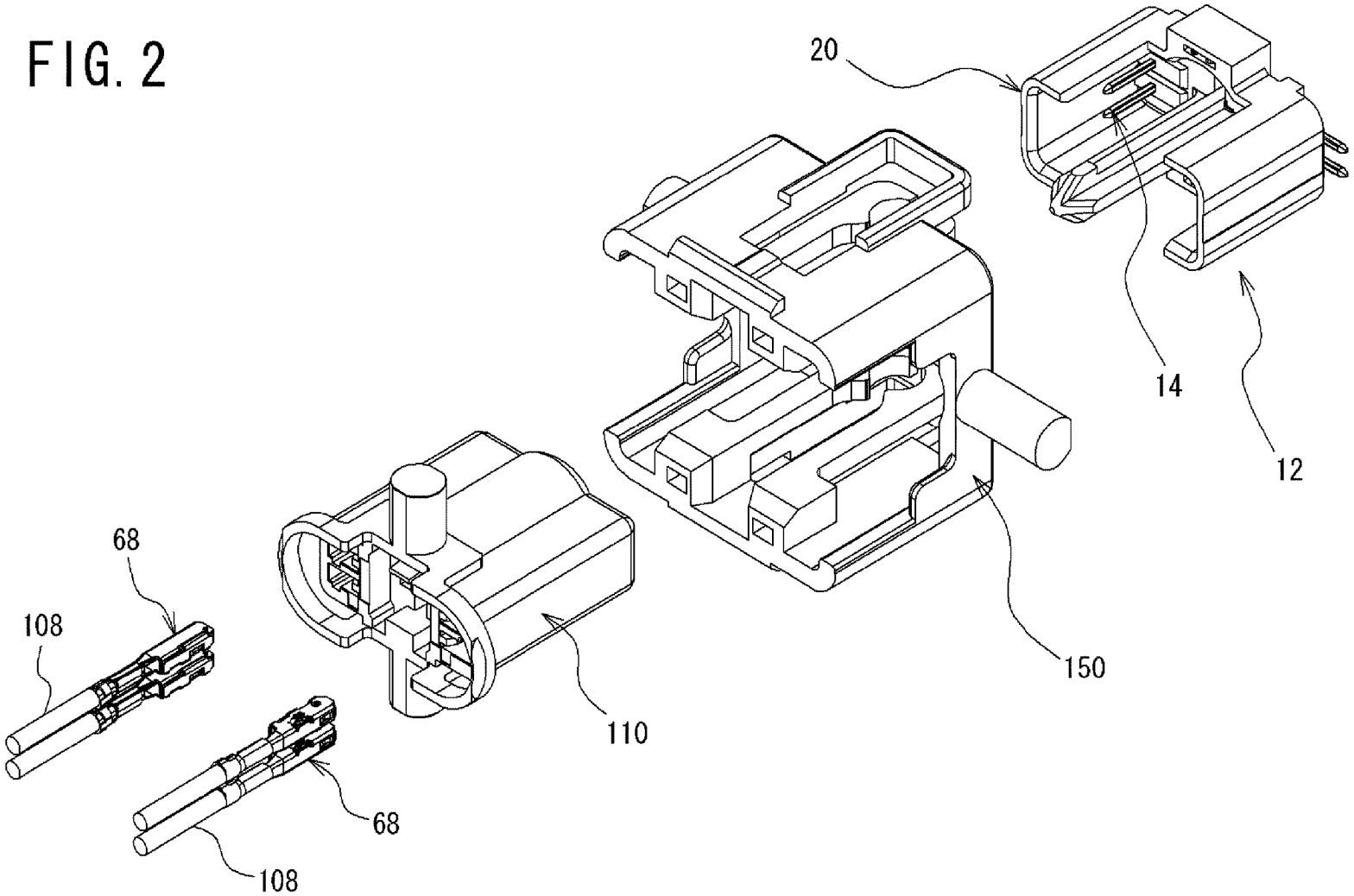
FIG. 2 is an exploded perspective view of the connector according to the embodiment.

When the fitting is started with the first connector member 12 and the second connector member 66 misaligned in the rotational direction, with regard to a state illustrated in FIGS. 1A and 1B, the guide pin 46 formed in the first housing 20 of the first connector member 12 is inserted into the guide hole 132 of the second housing 110 of the second connector member 66, while the fitting axis of the first connector member 12 is twisted against the second connector member 66. Then, as illustrated in FIG. 19A, the tapered portion 50 formed at the tip side of the guide pin 46 is guided by the guide hole 132 and inserted in the guide-pin guiding part 134.

Figure 19B:
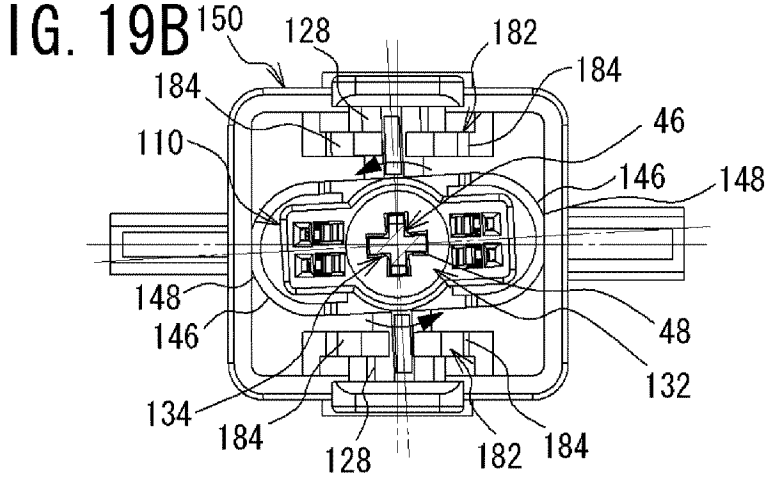
FIG. 19B is a cross-sectional view following FIG. 19A.

Here, although the guide pin 46 and the guide-pin guiding part 134 are brought into contact with each other while being misaligned in the rotational direction, the guide pin 46 formed into a cross shape is to be fitted to the guide-pin guiding part 134 formed into a cross shape, so that the second housing 110 is rotated to a direction allowing the fitting with respect to the first housing 20, and the inclination of the fitting axes is adjusted (see FIG. 19B).

As illustrated in FIGS. 19B and 19C, in the rotation of the second housing 110, the ring spring 146 of the second housing 110 is elastically deformed; the curved surface portion 148 is detached from the curved-surface concave portion 198 of the supporting part 196 of the supporting member 150; and the support claw 182 of the supporting member 150 that supports the shaft pin 128 of the second housing 110 is elastically deformed in the rotational direction while supporting the shaft pin 128, so that the second housing 110 is rotated.

Then, the misalignment in the rotational direction of the fitting axes of the first connector member 12 and the second connector member 66 is adjusted, enabling fitting of the first connector member 12 and the second connector member 66. Moreover, the fitting of the first connector member 12 and the second connector member 66 is performed in a same way as when there is no above-described misalignment or the like in the fitting axes (see FIGS. 14A to 14D).

[Positional misalignment in Z-axis direction] Next, positional misalignment in fitting when an additional force is applied in the fitting direction (Z-axis direction) after fitting of the first connector member 12 and the second connector member 66, is described with reference mainly to FIGS. 20A to 20C.

Figures 20A, 20B, 20C:
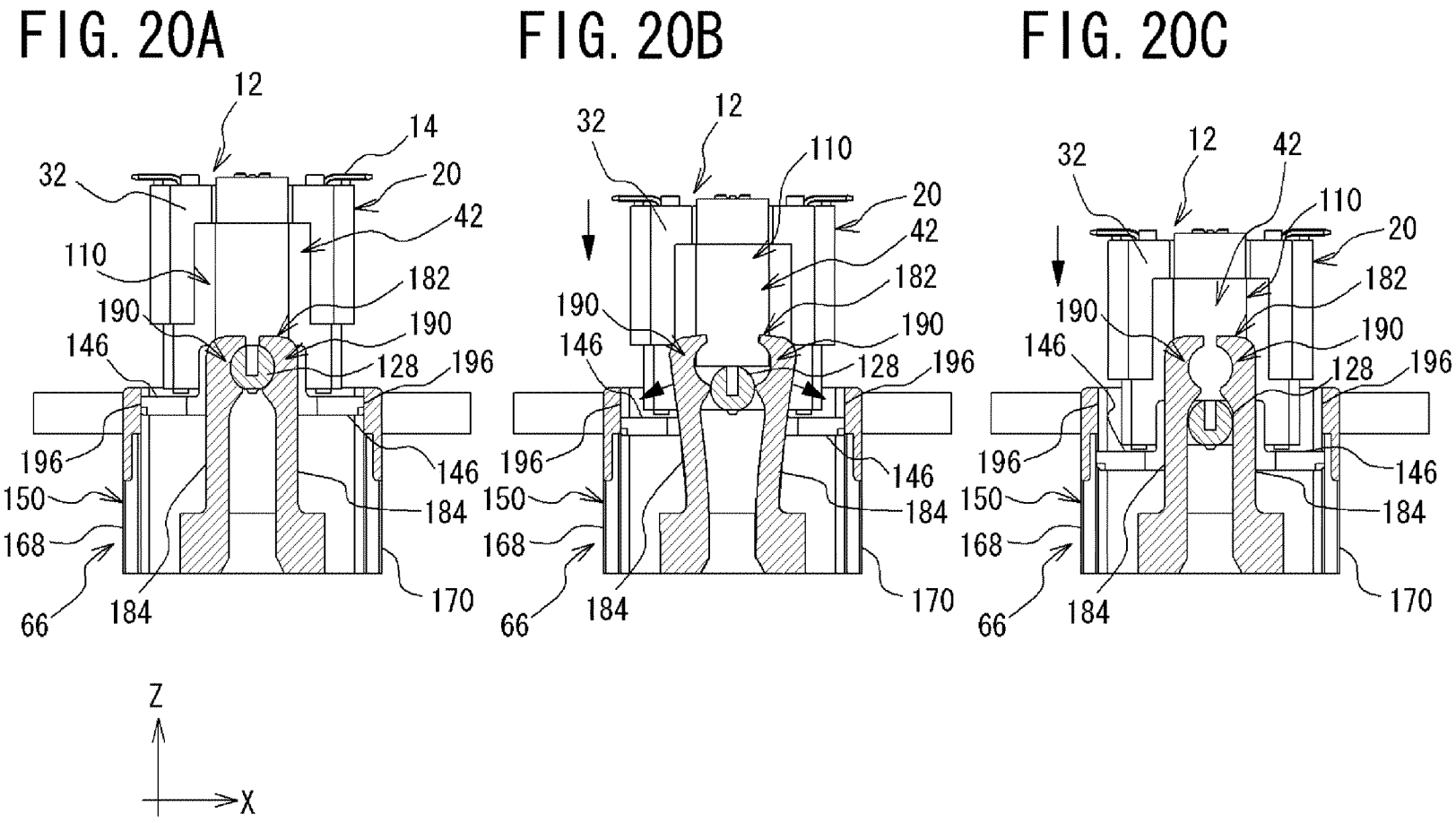
FIG. 20A is a cross-sectional view corresponding to FIG. 12A and explaining fitting when a force is applied in Z-axis direction after fitting of the first connector member and the second connector member.
FIG. 20B is a cross-sectional view following FIG. 20A.
FIG. 20C is a cross-sectional view following FIG. 20B.

When the first connector member 12 is moved further in the fitting direction from a state illustrated in FIG. 20A where the first connector member 12 and the second connector member 66 are fitted, a force is applied in the fitting direction from the first connector member 12 toward the second connector member 66 as illustrated in FIG. 20B, and the second housing 110 of the second connector member 66 is pressed, causing the movement of the shaft pin 128. This movement of the shaft pin 128 causes the shaft pin 128 to press the support claw 182 of the supporting member 150 that supports the shaft pin 128 of the second housing 110, causing elastic deformation of the support claw 182 toward a direction where the holding parts 190 are opened, and detachment of the shaft pin 128 from the holding parts 190 (see FIG. 20C).

When the support of the shaft pin 128 is released, only the second housing 110 fitted to the first housing 20 of the first connector member 12 is moved in the Z-axis direction (fitting direction), which is toward the rear part 156 side of the supporting member 150 in the embodiment. Here, the ring spring 146 of the second housing 110 is slid on the curved-surface concave portion 198 of the supporting part 196 of the supporting member 150, in accordance with the movement of the second housing 110, and released from the support by the supporting part 196.

Due to such a configuration, even when there is applied a larger force than that for fitting of the first connector member 12 and the second connector member 66 in the fitting direction, the force can be released, and breakage or the like of the first connector member and the second connector member can be prevented.

The force for detachment of the shaft pin 128 of the second housing 110 from the support claw 182 of the supporting member 150 is set to be larger than the force required for fitting of the first connector member 12 and the second connector member 66, which can prevent the shaft pin 128 from detaching from the support claw 182 before the first connector member 12 and the second connector member 66 are fitted.

When the second housing 110 is detached from the supporting member 150 of the second connector member 66, each of the support claws 182 of the supporting member 150 is fitted into the upper-surface open part 42 formed on the first upper surface 32 and the bottom surface open part 44 formed on the second bottom surface 34, of the first housing 20 of the first connector member 12.

Further, even when the fitting axes of the first connector member 12 and the second connector member 66 are misaligned or inclined in an oblique direction, namely, in a direction between X-axis direction and Y-axis direction, combining the adjustments in X-axis direction and Y-axis direction described above enables fitting of the first connector member and the second connector member.

What is claimed is:

1. A connector member having a housing that contains at least one contact, and a supporting member that has a cylindrical shape and configured to support the housing inside, the connector member being configured to be fitted to a counterpart connector member, the connector member comprising:

a pair of shaft pins extended from the housing and formed at positions opposed to each other on the supporting member side;

a support claw included in the supporting member and configured by a pair of claw pieces that hold each of the shaft pins, the support claw being elastically deformable; and an opening formed in the supporting member at a side from which the support claw extends and having a width wider than a width of the shaft pin, wherein when the housing is pressed in a fitting direction towards the supporting member, the shaft pins are moved to cause the claw pieces of the support claw to elastically deform, causing the shaft pins to detach from the support claw and enter into the opening.

2. The connector member according to claim 1, wherein the housing has a pair of elastic supporting members that are formed at positions opposed to each other on the supporting member side and orthogonal to the shaft pins, and are elastically deformable, the supporting member has a supporting part that supports each of the elastic supporting members, each of the elastic supporting members is formed of an oval spring body having a curved surface portion that has a curved surface shape and is supported by the supporting part of the supporting member, and the supporting part of the supporting member is formed with a curved-surface concave portion capable of being fitted with the curved surface portion of each of the elastic supporting members.

3. A connector having a configuration in which a first connector member having a first housing that contains at least one first contact is fitted with a second connector member having a second housing that contains at least one second contact to be contacted with the first contact, and a supporting member that has a cylindrical shape and is configured to support the second housing inside, the connector comprising:

a pair of shaft pins extended from the second housing and formed at positions opposed to each other on the supporting member side;

a support claw included in the supporting member and configured by a pair of claw pieces that hold each of the shaft pins, the support claw being elastically deformable; and an opening formed in the supporting member at a side from which the support claw extends and having a width wider than a width of the shaft pin, wherein after the first connector member and the second connector member are fitted together, when a pressure is applied thereto towards a fitting direction and towards each other, the shaft pins are moved to cause the claw pieces of the support claw to elastically deform, causing the shaft pins to detach from the support claw and enter into the opening.

4. The connector according to claim 3, wherein, at portions opposed to each other at end sides of the claw pieces of the support claw, there is formed a recessed portion into which each of the shaft pins is fitted, and a holding part configured by holding projection parts protruding on both ends of the recessed portion.

5. The connector according to claim 3, wherein the holding claw is configured to be elastically deformed by a larger pressing force than that of when the first connector member is fitted with the second connector member.

6. The connector according to claim 3, wherein the second housing has a pair of elastic supporting members that are formed at positions opposed to each other on the supporting member side and orthogonal to the shaft pins, and are elastically deformable, the supporting member has a supporting part that supports each of the elastic supporting members, each of the elastic supporting members is formed of an oval spring body having a curved surface portion that has a curved surface shape and is supported by the supporting part of the supporting member, and the supporting part of the supporting member is formed with a curved-surface concave portion capable of being fitted with the curved surface portion of each of the elastic supporting members.

7. The connector according to claim 6, wherein, in the curved-surface concave portion of the supporting part, a side to be fitted with the first connector is closed, and there is provided an abutting part against which the curved surface portion of each of the elastic supporting members of the second housing abuts.

8. The connector according to claim 3, wherein the first housing is formed with a guide pin that is extended to a side to be fitted to the second housing, and inside the second housing, there is formed a guide-pin guiding part that is inserted with the guide pin, and the guide-pin guiding part is, on a side to be inserted with the guide pin, formed with a guide hole that guides the guide pin to the guide-pin guiding part.

9. The connector according to claim 8, wherein, in the guide pin, a cross section orthogonal to an extending direction is formed into a polygonal shape, and a tapered portion is formed in which a tip side to be inserted into the guide hole is chamfered, the guide-pin guiding part is formed into a shape corresponding to a shape of the guide pin, and the guide hole is formed into a chamfered conical shape.

10. The connector according to claim 9, wherein the guide-pin guiding part is formed with a lock piece capable of repeatedly moving, and a lock projection that is formed to protrude on the lock piece, the guide pin is formed with a lock part to be engaged with the lock projection, when the first connector and the second connector are fitted, the lock projection of the guide-pin guiding part is engaged to the lock part of the guide pin to fix the first connector and the second connector, and moving a lock piece causes the lock projection to move and disengage from the lock part.

* * * * *